US010509356B2

(12) United States Patent
Zaitsu et al.

(10) Patent No.: US 10,509,356 B2
(45) Date of Patent: Dec. 17, 2019

(54) IMAGE FORMING APPARATUS

(71) Applicant: CANON KABUSHIKI KAISHA, Tokyo (JP)

(72) Inventors: Yoshitaka Zaitsu, Suntou-gun (JP); Kazushi Suzuki, Suntou-gun (JP); Atsushi Ogata, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/270,957

(22) Filed: Feb. 8, 2019

(65) Prior Publication Data

US 2019/0250549 A1 Aug. 15, 2019

(30) Foreign Application Priority Data

Feb. 13, 2018 (JP) ..... 2018-023251

(51) Int. Cl.
*G03G 15/00* (2006.01)
*G03G 21/20* (2006.01)

(52) U.S. Cl.
CPC ..... *G03G 15/6579* (2013.01); *G03G 15/5029* (2013.01); *G03G 21/206* (2013.01)

(58) Field of Classification Search
CPC ..... G03G 15/6579; G03G 15/5029; G03G 15/5062; G03G 21/206
See application file for complete search history.

(56) References Cited

U.S. PATENT DOCUMENTS 7,536,145 B2 * 5/2009 Tomine ..... G03G 15/2017 399/328
8,340,560 B2 * 12/2012 Okuno ..... G03G 15/2028 399/323
9,215,346 B2 12/2015 Uchidate et al.
2012/0070215 A1 * 3/2012 Murakami ..... G03G 15/6573 399/405

FOREIGN PATENT DOCUMENTS

JP 2005-165215 A 6/2005
JP 2013-235065 A 11/2013

* cited by examiner

*Primary Examiner* — Hoang X Ngo
(74) *Attorney, Agent, or Firm* — Venable LLP

(57) ABSTRACT

An image forming apparatus includes an image forming portion, a fixing portion, a reversing portion, a re-feeding path, a detecting portion, a first feeding path, a second feeding path, an air flow generating portion, and a flow path forming portion. The flow path forming portion forms a flow path along which air flow is passed through between a recording material passing through the second feeding path and a constituent portion constituting the second feeding path on a side toward the detecting portion and guides the recording material passing through the second feeding path, when the recording material passes through the second feeding path.

17 Claims, 12 Drawing Sheets

IMAGE FORMING APPARATUS

FIELD OF THE INVENTION AND RELATED ART

The present invention relates to an image forming apparatus such as a copying machine or a printer.

In Japanese Laid-Open Patent Application (JP-A) 2005-165215, an image sensor for reading both an original image and a toner image printed on a recording material is provided between a first discharging roller and a second discharging roller. Then, both pieces of image information read by the image sensor are compared with each other, and then printed image correction and recording material position correction are made.

In JP-A 2013-235065, an original reading portion is provided along a common feeding path along which both a recording material and an original are fed, and a printed image prepared on the basis of image information of the original detected by the original reading portion is printed on the original in an overwriting manner.

In JP-A 2005-165215 and JP-A 2013-235065, positions of the image sensor and the original reading portion which detect the toner image and the original image which are printed on the recording material (hereinafter these portions are referred to as an "image reading portion") will be considered. At this time, the image reading portion is provided in the neighborhood of a fixing device for heat-fixing the toner image formed on the recording material.

For fixing the toner image, heat and pressure are used, and therefore, during a printing operation, a temperature in the neighborhood of the fixing device is relatively high. As a result of temperature rise in the neighborhood of the fixing device, also the recording material after the fixing of the image thereon increases in temperature. The image on the recording material increased in temperature is read by an image sensor (CIS (contact image sensor) or the like). As regards a feeding speed of the recording material at that time, when the recording material is fed at the feeding speed such that a temperature of the image sensor is higher than a temperature condition in which the image sensor (CIS or the like) is operable, a lowering in reading accuracy of the image occurs in some cases.

On the other hand, in the image reading portion, sensors, such as the contact image sensor (CIS) which is also employed in JP-A 2005-165215 and JP-A 2013-235065, in which elements for converting light to electric signal are arranged in a line, are generally used. Most of the sensors change in photoelectric conversion efficiency due to temperature rise, and when the temperature of the image sensor is higher than the temperature condition in which the image sensor is operable, the influence on the image reading accuracy (i.e., a lowering in accuracy of density, position, size and the like of the image) occurs.

For that reason, in the case where the image reading portion is disposed in the neighborhood of the fixing device, it is preferable that a cooling portion for cooling the image reading portion is provided. As regards the cooling portion, the image reading portion can also be cooled by blowing air for cooling onto the image reading portion, but when a feeding path through which air flow passes is provided in the neighborhood of the image reading portion, there is liability that the image forming apparatus is upsized.

SUMMARY OF THE INVENTION

The present invention has solved the above-described problem. A principal object of the present invention is to provide an image forming apparatus capable of cooling a detecting portion for detecting predetermined information from a recording material without upsizing the image forming apparatus.

According to an aspect of the present invention, there is provided an image forming apparatus comprising: an image forming portion configured to form a developer image on a recording material; a fixing portion configured to heat-fix the developer image formed by the image forming portion on the recording material; a reversing portion configured to reverse a feeding direction of the recording material passed through the fixing portion; a re-feeding path configured to feed the recording material reversed by the reversing portion to the image forming portion again; a detecting portion configured to detect predetermined information from the recording material; a first feeding path along which the recording material passes through a side of a detecting surface of the detecting portion; a second feeding path along which the recording material passes through a side opposite from the detecting surface of the detecting portion and which includes a merging portion where the second feeding path merges with a feeding path configured to feed the recording material passed through the fixing portion; an air flow generating portion configured to generate air flow; and a flow path forming portion configured to form a flow path along which the air flow is passed through between the recording material passing through the second feeding path and a constituent portion constituting the second feeding path on a side toward the detecting portion and configured to guide the recording material passing through the second feeding path, when the recording material passes through the second feeding path.

Further features of the present invention will become apparent from the following description of exemplary embodiments with reference to the attached drawings.

Figure 6:
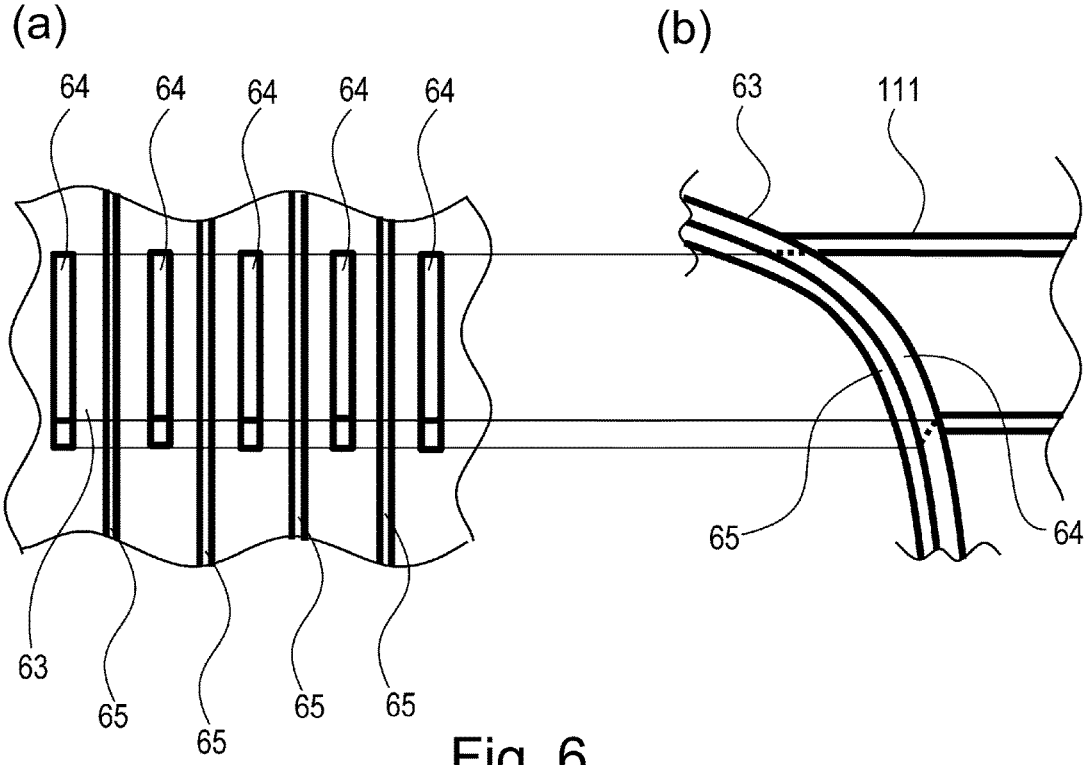

Part (a) of FIG. 6 is a front view showing a structure of a feeding guide, and part (b) of FIG. 6 is a sectional view showing the structure of the feeding guide.

Figure 7:
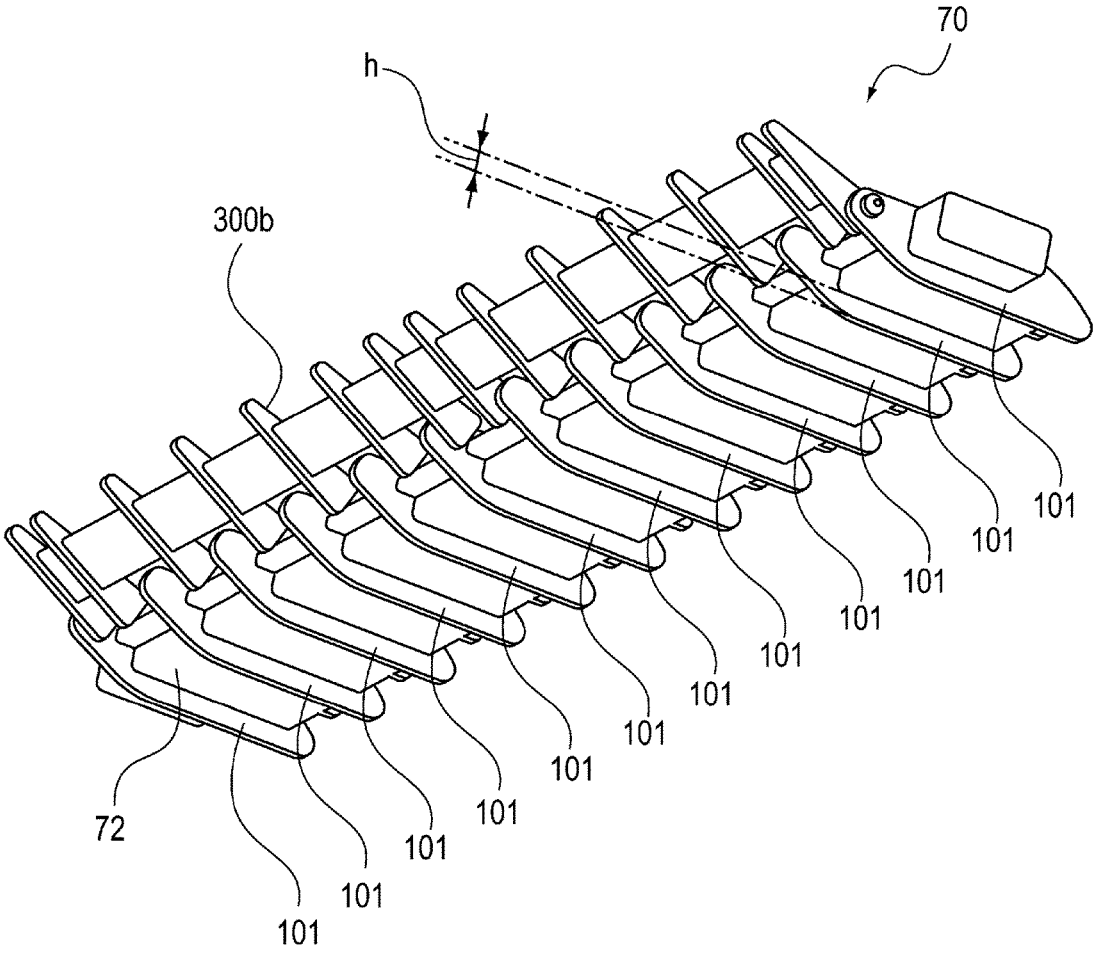

FIG. 7 is a perspective view of a structure of a guiding rib provided at a bottom of the image reading portion.

Figure 8:
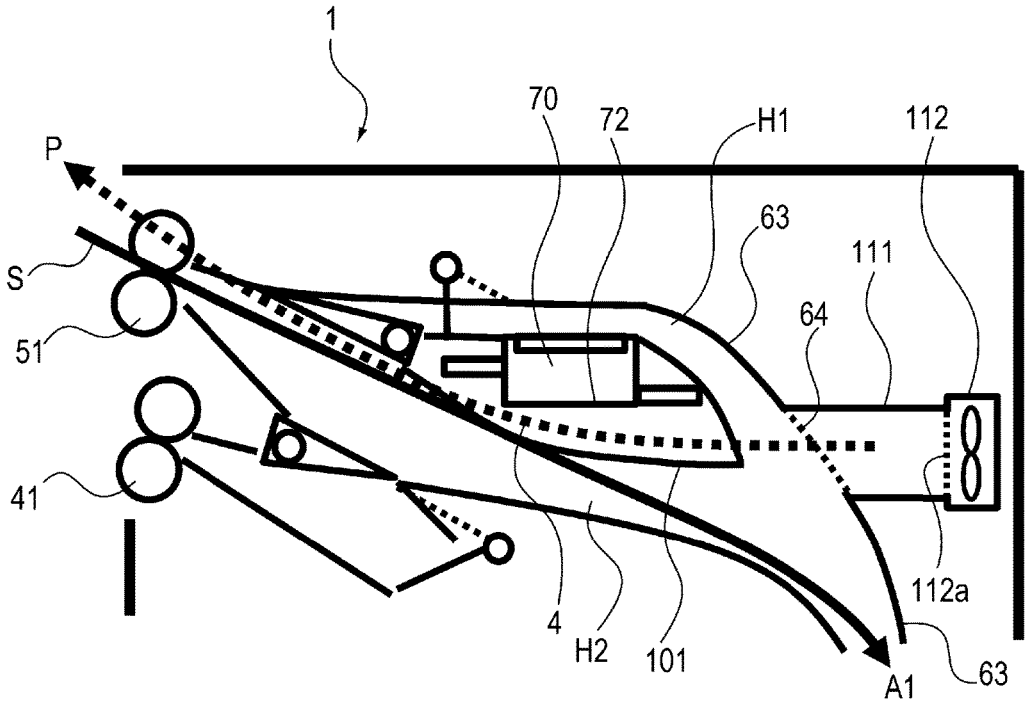

FIG. 8 is a sectional view showing the guiding rib disposed at the bottom of the image reading portion and an air flow for cooling in the First Embodiment.

Figure 9:
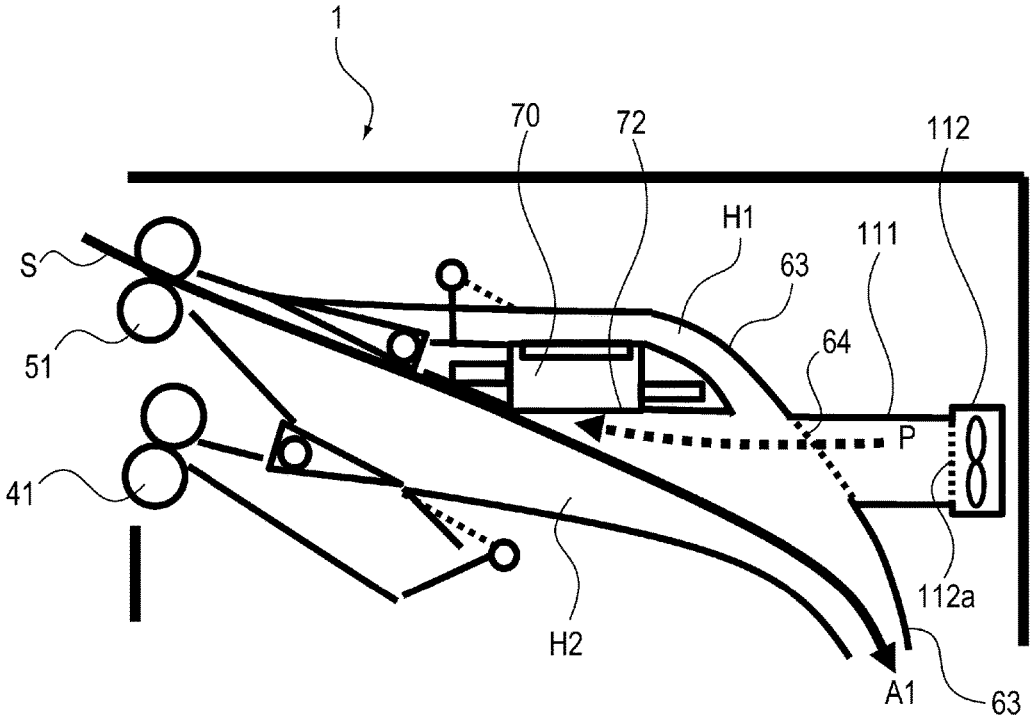

FIG. 9 is a sectional view showing an air flow for cooling in a comparison example in which the guiding rib is not disposed at the bottom of the image reading portion.

Figure 10:
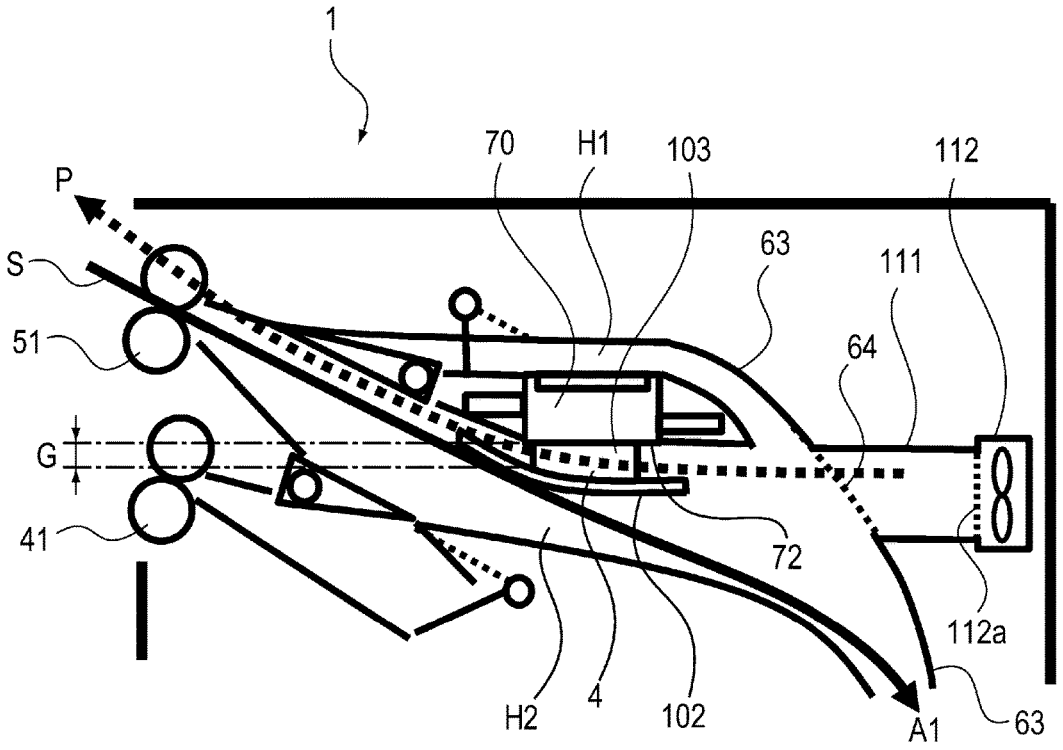

FIG. 10 is a sectional view showing a guiding plate provided at the bottom of the image reading portion and the air flow for cooling in the First Embodiment.

Figure 11:
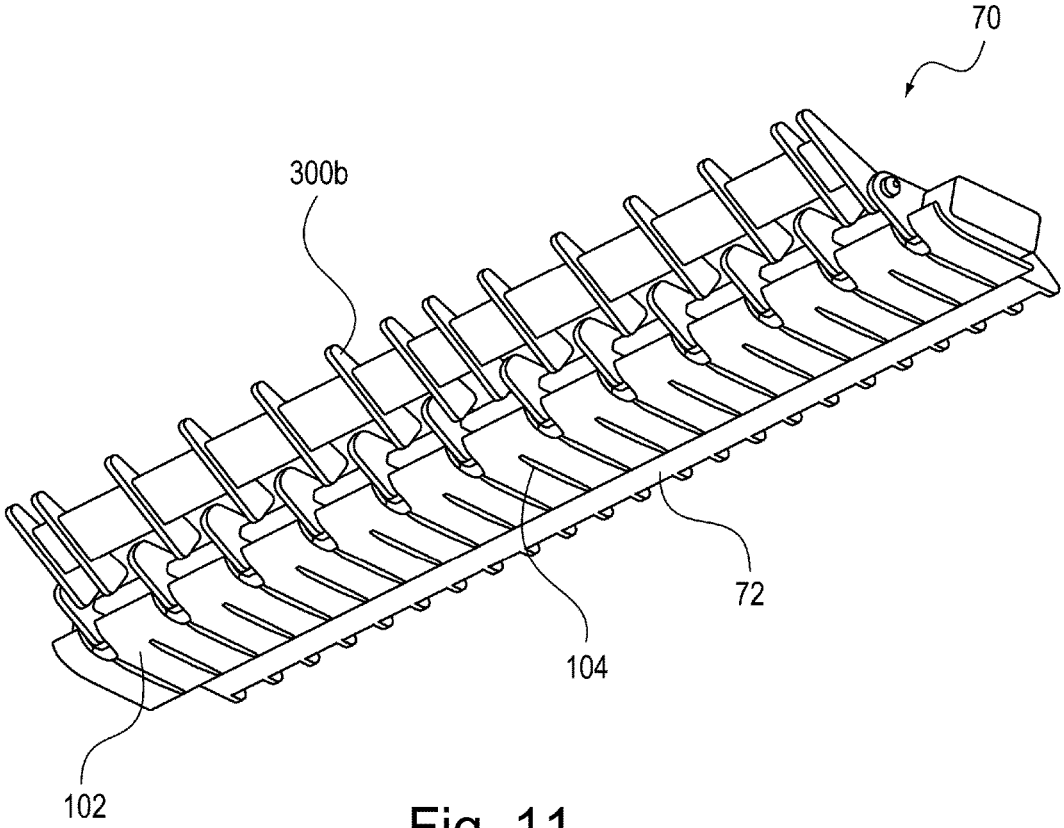

FIG. 11 is a perspective view showing a structure of the guiding plate disposed at the bottom of the image reading portion.

Figure 12:
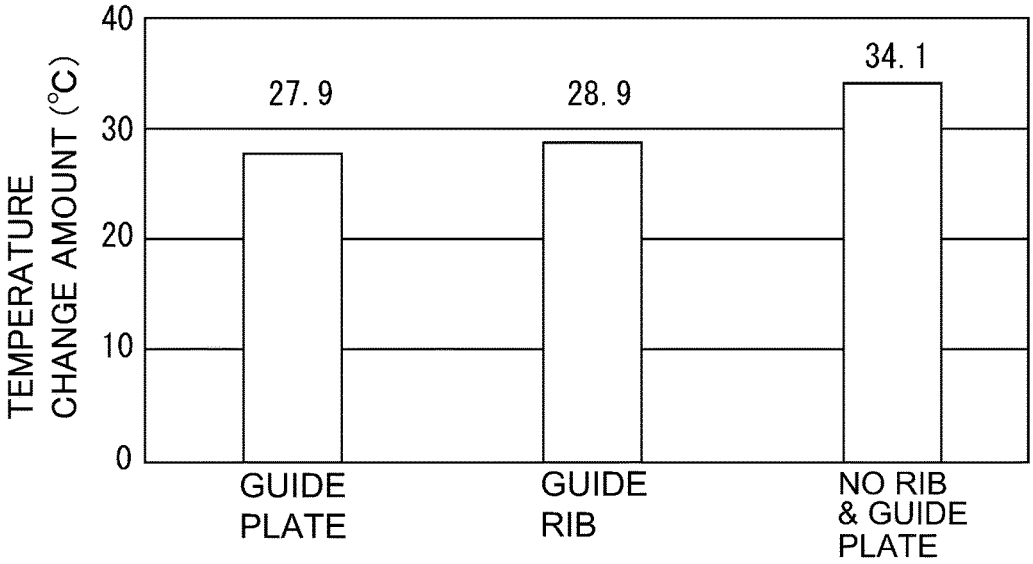

FIG. 12 is a graph showing cooling efficiency of the image reading portion in each of the case where the guiding rib is disposed, the case where the guiding plate is disposed and the case where the guiding rib and the guiding plate are not provided, at the bottom of the image reading portion.

Figure 13:
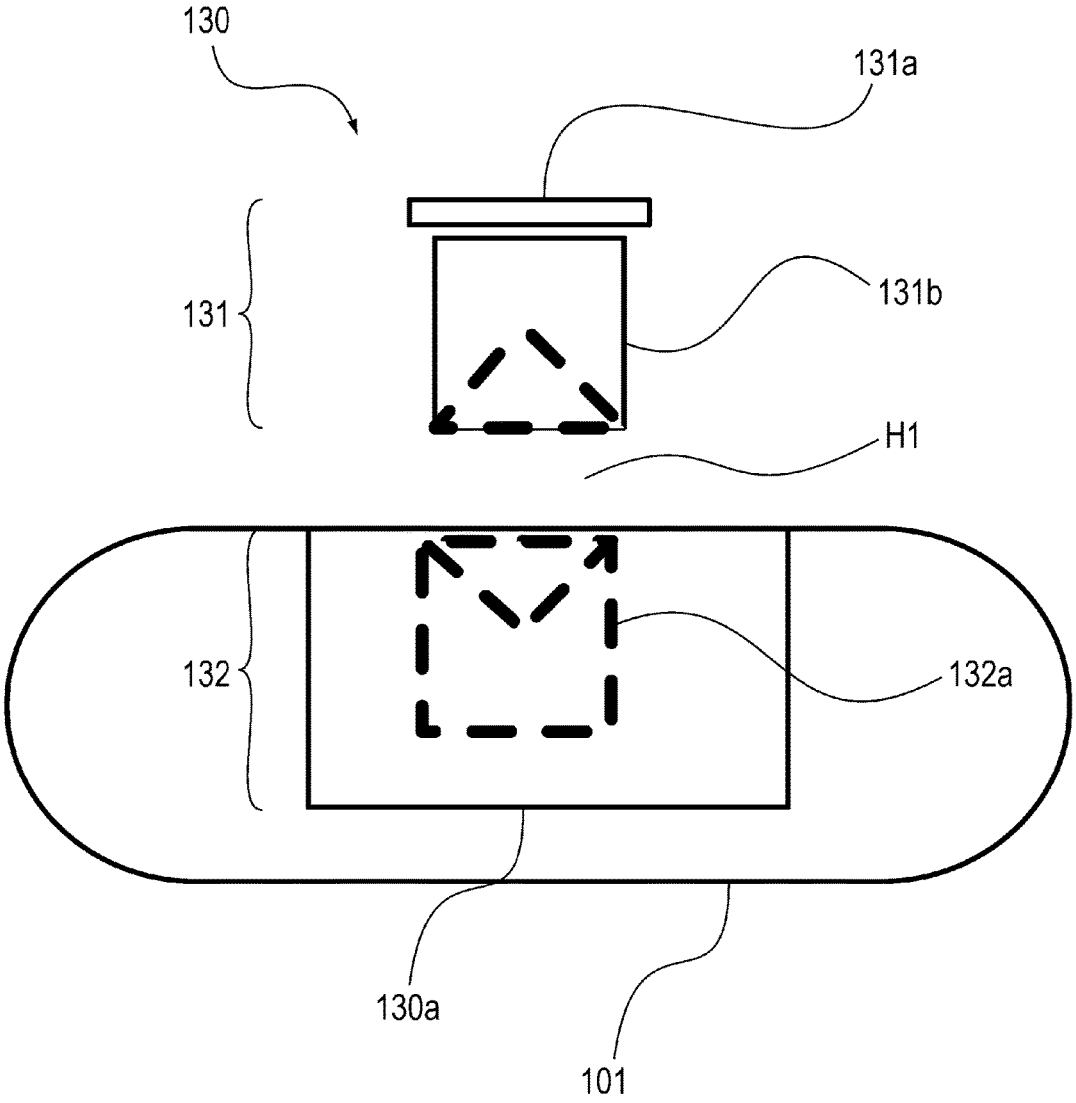

FIG. 13 is a side view showing structures of an ultrasonic sending device provided at a sending portion of a basis weight detecting portion and an ultrasonic receiving device provided at a receiving portion of the basis weight detecting portion.

Figure 14:
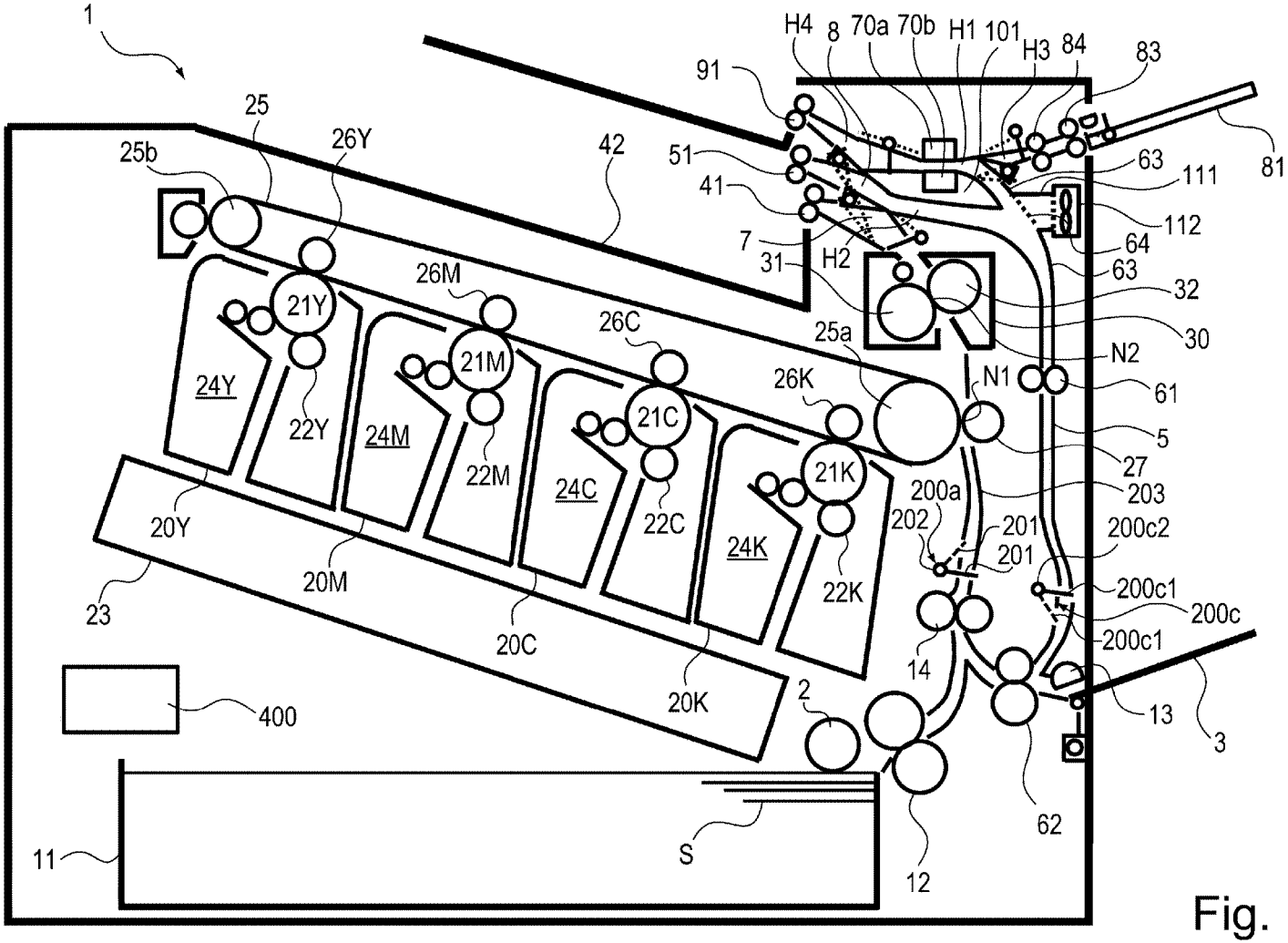

FIG. 14 is a sectional view showing a structure of an image forming apparatus according to the present invention in a Second Embodiment.

Figure 15:
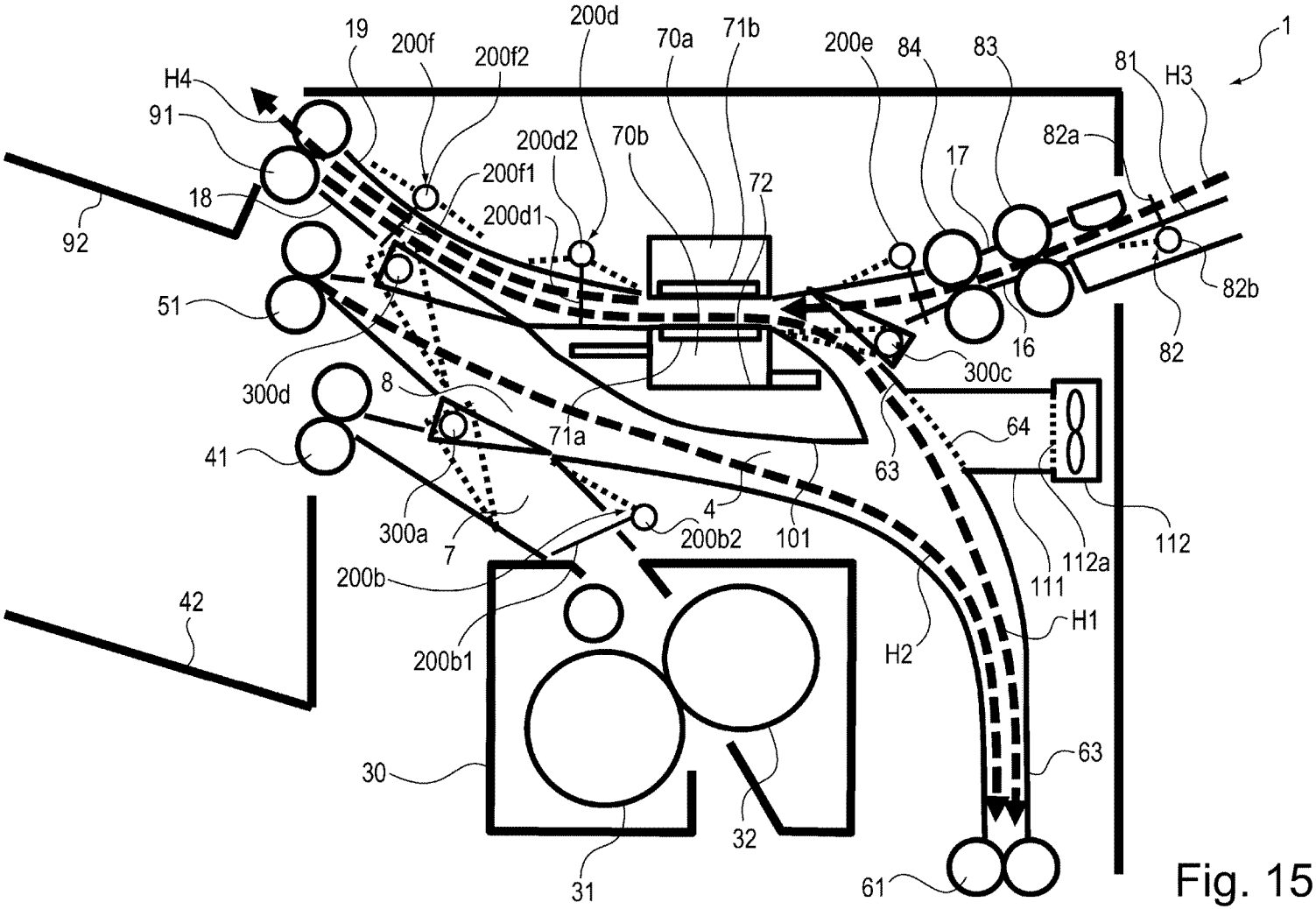

FIG. 15 is a partially enlarged view of FIG. 14, showing a structure of a periphery of an image reading portion in Second Embodiment.

DESCRIPTION OF EMBODIMENTS

Embodiments of an image forming apparatus according to the present invention will be specifically described with reference to the drawings.

First Embodiment

First, with reference to FIGS. 1 to 13, a structure of an image forming apparatus according to the present invention in a First Embodiment will be described.

<Image Forming Apparatus>

Figure 1:
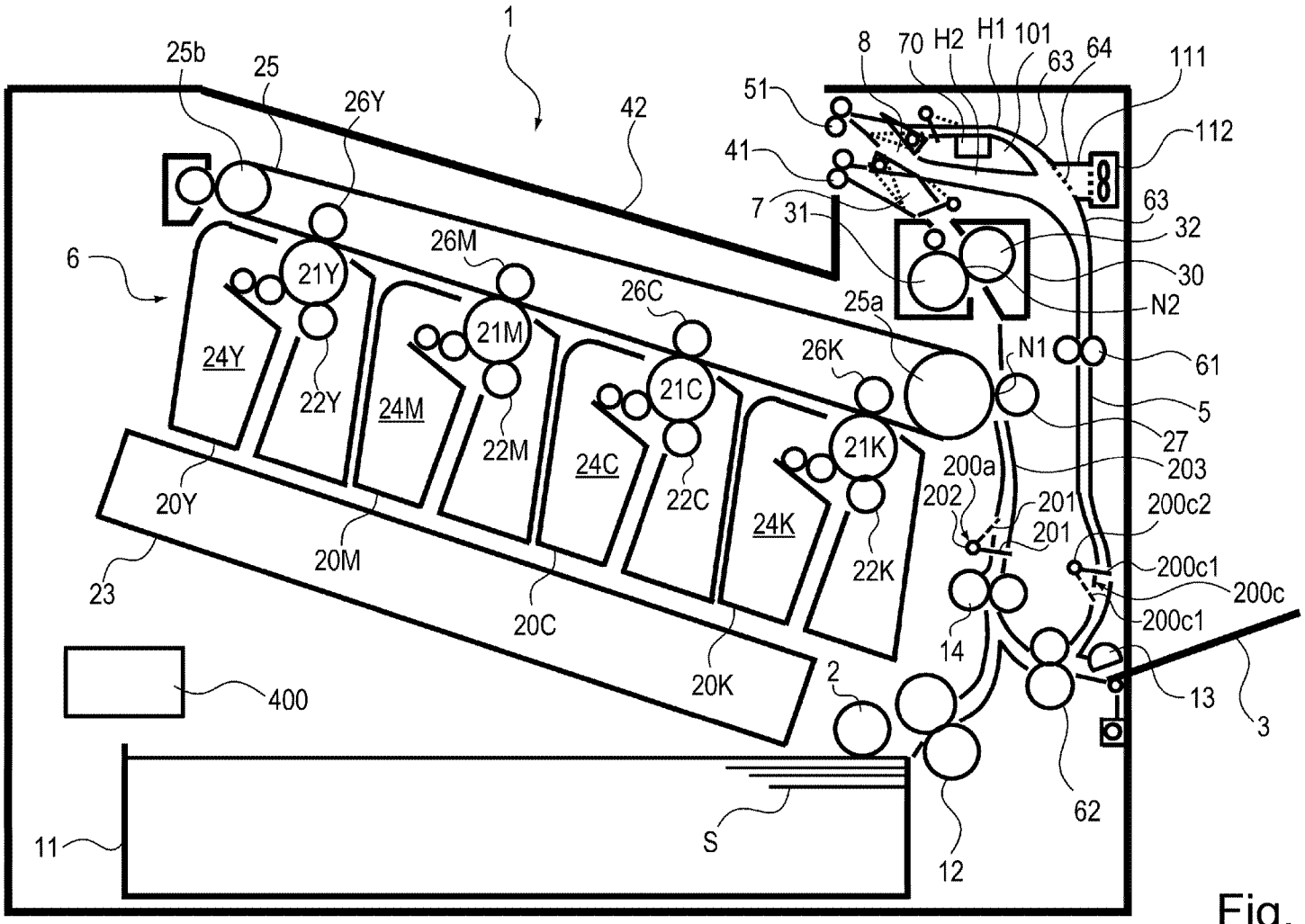
FIG. 1 is a sectional view showing a structure of an image forming apparatus according to the present invention in a First Embodiment.
Figure 2:
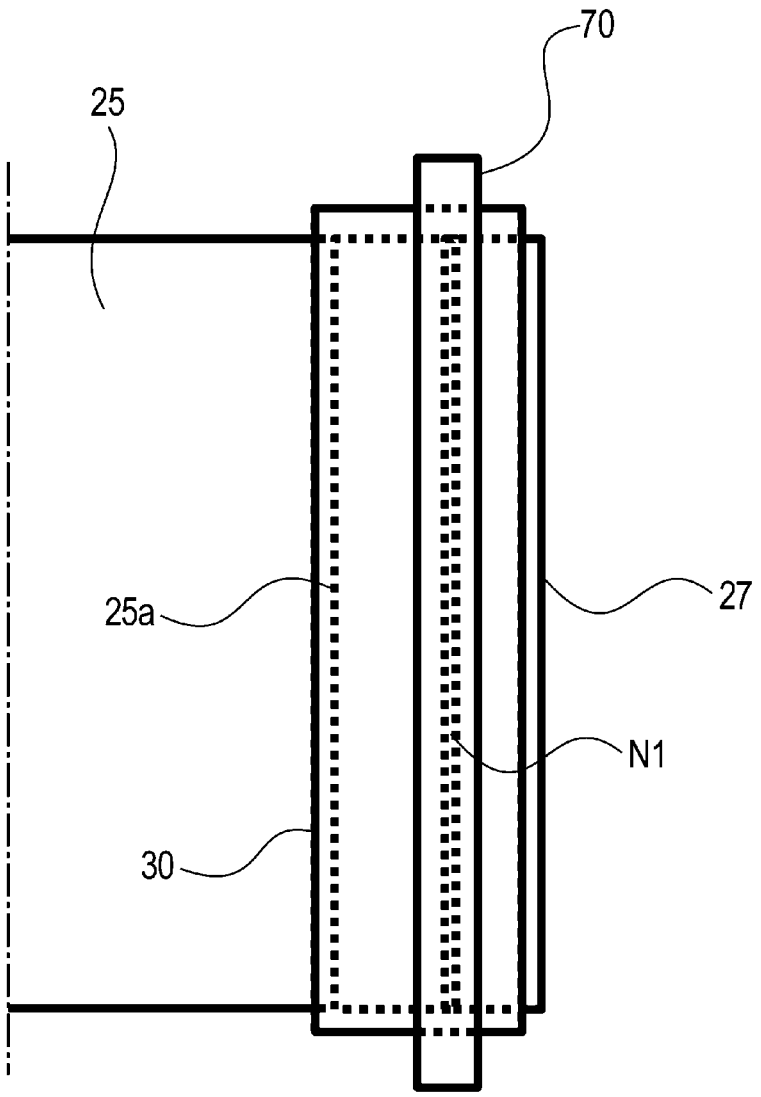
FIG. 2 is a schematic view showing an image reading portion (detecting portion), a fixing device (fixing portion) and a secondary transfer roller (transfer portion) which are shown in FIG. 1, as seen from above the image forming apparatus of FIG. 1.
Figure 3:
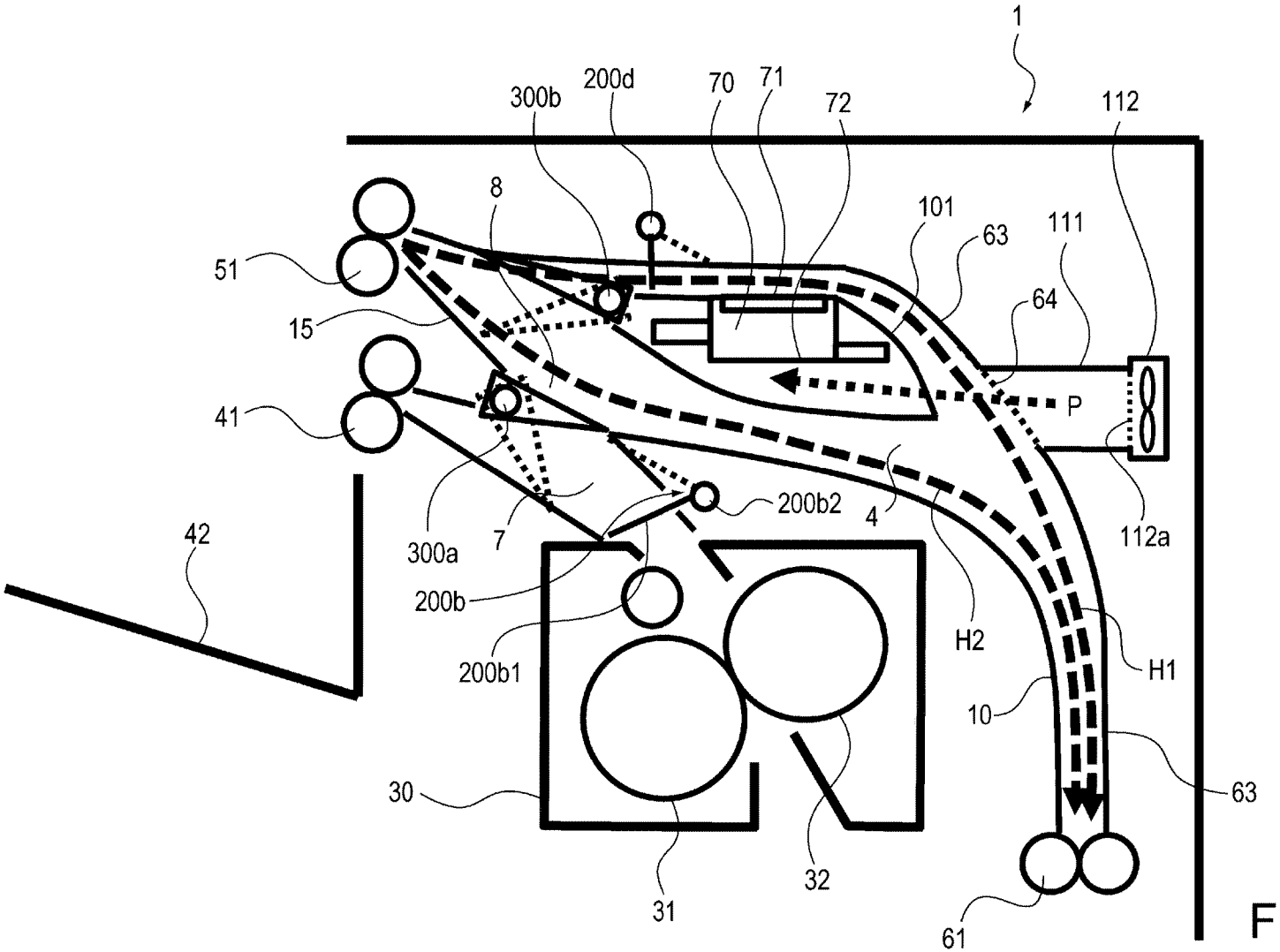
FIG. 3 is a partially enlarged view of FIG. 1, showing a structure of a periphery of the image reading portion in the First Embodiment.

With reference to FIGS. 1 to 3, a structure of an image forming apparatus 1 of this embodiment will be described. FIG. 1 is a sectional view showing the structure of the image forming apparatus 1 in this embodiment. FIG. 2 is a schematic view showing an image reading portion (detecting portion) 70, a fixing device (fixing portion) 30 and a secondary transfer roller (transfer portion) 27 which are shown in FIG. 1, as seen from above the image forming apparatus 1 of FIG. 1. FIG. 3 is a partially enlarged view of FIG. 1, showing a structure of a periphery of the image reading portion 70. The image forming apparatus 1 shown in FIG. 1 is an example of a laser beam printer.

The image forming apparatus 1 shown in FIG. 1 includes image forming stations 20Y, 20M, 20C and 20K, which constitute a part of an image forming portion 6, corresponding to colors of yellow Y, magenta M, cyan C and black K, respectively. Incidentally, the image forming stations 20Y, 20M, 20C and 20K are constituted substantially similarly except that colors of toners (developers) used are different from each other, and therefore, in some cases, these stations are described using the image forming station(s) 20 as a representative. This is also true for other image forming process portions.

The respective image forming stations 20 constitute a part of the image forming portion 6 for forming a developer image (toner image) on a recording material S. The respective image forming stations 20Y, 20M, 20C and 20K are juxtaposed substantially in a line along a left-right direction of FIG. 1. The respective image forming stations 20 are provided with photosensitive drums 21Y, 21M, 21C and 21K, respectively, which are image bearing members rotatable in a clockwise direction of FIG. 1. At peripheries of the photosensitive drums 21, charging rollers 22Y, 22M, 22C and 22K which are cooling portions for electrically charging surfaces of the respective photosensitive drums 21 uniformly are provided.

Below the photosensitive drums 21, a scanner unit 23 which is an exposure portion is provided. The scanner unit 23 is controlled by a controller 400. The scanner unit 23 irradiates the uniformly charged surface of each of the photosensitive drums 21 with laser light on the basis of image information, so that an electrostatic latent image is formed on the surface of each of the photosensitive drums 21.

The image information held by the controller 400 is prepared on the basis of image information received from an external device or the like directly connected with a personal computer on a network or with the image forming apparatus 1. Or, the image information is stored in a memory of the controller 400 in advance. At peripheries of the photosensitive drums 21, developing devices 24Y, 24M, 24C and 24K which are developing portions for developing the electrostatic latent images formed on the surfaces thereof into toner images, by supplying the toners (developers) to the electrostatic latent images formed on the surfaces of the respective photosensitive drums 21 are provided.

An intermediary transfer belt 25 is provided opposed to the respective photosensitive drums 21. The intermediary transfer belt 25 is stretched rotatably in the counterclockwise direction by stretching rollers 25*a* and 25*b*. On an inner peripheral surface side, primary transfer rollers 26Y, 26M, 26C and 26K which are primary transfer portions are provided opposed to the photosensitive drums 21.

The toner images formed on the surfaces of the photosensitive drums 21 are successively primary-transferred and superposed onto an outer peripheral surface of the intermediary transfer belt 25 by applying primary transfer biases from an unshown primary transfer bias voltage source to the primary transfer rollers 26. A secondary transfer roller 27 which is a secondary transfer portion is provided opposed to the stretching roller 25*a* through the intermediary transfer belt 25.

The image forming portion 6 for forming the developer images (toner images) on the recording materials P is constituted by including the respective image forming stations 20 and the intermediary transfer belt 25. The intermediary transfer belt 25 is constituted as an image carrying member for carrying the developer images (toner images). The secondary transfer roller 27 is constituted as a transfer portion for transferring the developer images (toner images) carried on the outer peripheral surface of the intermediary transfer belt (image carrying member) 25 onto the recording material S.

With respect to a vertical direction (up-down direction) shown in FIG. 1, the secondary transfer roller (transfer portion) 27, the fixing device (fixing portion) 30 and the image reading portion (detecting portion) 70 are disposed in a named order from below the secondary transfer roller 27 in FIG. 1. These members are disposed at an overlapping position as seen in the vertical direction.

The image sensor and the original reading portion disclosed in JP-A 2005-165215 and JP-A 2013-235065 are disposed at positions avoiding a position immediately above the fixing device or the fixing portion which are in a high-temperature state. For this reason, there is a problem such that the image forming apparatuses are upsized. In this embodiment, as seen in the vertical direction, the fixing device (fixing portion) 30 and the image reading portion (detecting portion) 70 can be disposed at an overlapping position. For this reason, the image forming apparatus 1 can be downsized.

<First Feeding Path>

As shown in FIG. 3, a first feeding path H1 is a feeding path provided between a reversing roller pair (reversing portion) 51 and a both side feeding roller pair (feeding portion for both side printing) 61 on a detecting surface 71 side of the image reading portion (detecting portion) 70. The first feeding path H1 is constituted by a feeding guide 63, a part of an upper side of a guiding rib (flow path forming portion) 101, a flapper 300*b*, a part of the feeding guide 10, and the like. The feeding guide 63 provided with an opening 64 is provided over an entirety ranging from the reversing roller pair 51 to the both side feeding roller pair 61 of the first feeding path H1.

<Second Feeding Path>

As shown in FIG. 3, a second feeding path H2 is a feeding path provided between a reversing roller pair (reversing portion) 51 and a both side feeding roller pair (feeding portion for both side printing) 61 on a bottom 72 side opposite from the detecting surface 71 side of the image reading portion (detecting portion) 70. The second feeding path H1 is constituted by feeding guides 10 and 15, a flapper 300*a*, a part of a lower side of the guiding rib (flow path forming portion) 101, the flapper 300*b*, a part of the feeding guide 63, and the like.

The image reading portion 70 is provided at an opposing position to the fixing device (fixing portion) 30 while sandwiching the second feeding path H2 between itself and the fixing device 30.

On the other hand, at a lower portion of the image forming apparatus 1, a (sheet) feeding cassette 11 accommodating the recording material(s) S is provided so as to be drawable relative to a main assembly of the image forming apparatus 1. The recording material S accommodated in the feeding cassette 11 is fed by a feeding roller 2 and then is separated and fed one by one in cooperation with an unshown separating portion. Thereafter, the recording material S is nipped and fed by a feeding roller pair 12.

The recording material S nipped and fed by the feeding roller pair 12 is abutted at its leading end against a nip of a registration roller pair 14 at rest, so that oblique movement of the recording material S is corrected. Timing when a leading end of the toner image carried on the outer peripheral surface of the intermediary transfer belt 25 reaches a secondary transfer nip N1 formed by the outer peripheral surface of the intermediary transfer belt 25 and the secondary transfer roller 27 will be considered. In synchronism with this timing, the recording material S is fed to the secondary transfer nip N1 by being nipped by the registration roller pair 14.

Downstream of the registration roller 14, a feeding sensor 200*a* is provided. A sensor arm 201 of the feeding sensor 200*a* is pushed and rotated about a rotation shaft 202 in the counterclockwise direction by the recording material S and thus is rotationally moved to a position indicated by a broken line of FIG. 1, so that normal feeding of the recording material S is detected.

Further, on a right-hand side of the image forming apparatus 1 in FIG. 1, a manually feeding tray 3 is provided. The recording material S placed on the manually feeding tray 3 is fed by a feeding roller 13 and is separated and fed one by one in cooperation with an unshown separating portion. Thereafter, the recording material S is nipped and fed by a feeding roller pair 62.

The recording material S nipped and fed by the feeding roller pair 62 is abutted at its leading end against a nip of a registration roller pair 14 at rest, so that oblique movement of the recording material S is corrected. Thereafter, in synchronism with timing when a leading end of the toner image carried on the outer peripheral surface of the intermediary transfer belt 25 reaches the secondary transfer nip N1, the recording material S is fed to the secondary transfer nip N1 by being nipped by the registration roller pair 14.

When the recording material S fed from the feeding cassette 11 or the manually feeding tray 3 reaches the secondary transfer nip N1, a secondary transfer bias is applied from an unshown secondary transfer bias voltage source to the secondary transfer roller 27. As a result, the toner images primary-transferred on the outer peripheral surface of the intermediary transfer belt 25 are secondary-transferred onto the recording material P altogether.

Thereafter, the recording material S is fed to the fixing device 30 which is a fixing portion by being nipped by the outer peripheral surface of the intermediary transfer belt 25 and the secondary transfer roller 27. Then, the recording material S passes through a fixing nip N2 formed by a heating unit 31 and a pressing roller 32 press-contacted to the heating unit 31 which are provided inside of the fixing device 30. At this time, the toner image carried on the recording material S is heated and pressed and thus is heat-fixed. The fixing device 30 heat-fixes the developer image (toner image) formed by the image forming portion 6 on the recording material S.

As shown in FIG. 3, downstream of the fixing device 30, a feeding sensor 200*b* is provided. A sensor arm 200*b*1 of the feeding sensor 200*b* is pushed and rotated about a rotation shaft 200*b*2 in the clockwise direction of FIG. 3 by the recording material S and thus is retracted to a position indicated by a broken line of FIG. 3, so that normal feeding of the recording material S coming out of the fixing device 30 is detected.

In the case where the recording material S is discharged to an outside of the image forming apparatus 1, a flapper 300*a* is rotationally moved to a position indicated by a solid line of FIG. 3 by using an unshown driving portion such as a solenoid, a motor or spring until the leading end of a recording material S with respect to a traveling direction passes through the fixing device 30. The recording material S coming out of the fixing device 30 is guided by the flapper 300*a* and is introduced by a discharging roller pair 41, and is passed onto a discharge tray 42 by being nipped and fed by the discharging roller pair 41. Incidentally, in place of the discharge tray 42, a feeding path for feeding the recording material S discharged by the discharging roller pair 41 to an unshown post-processing device provided in the neighborhood of the image forming apparatus 1 is formed, and then a post-process such as division, stapling or sorting of the recording materials can also be performed.

<Feeding Sensor>

Figure 4:
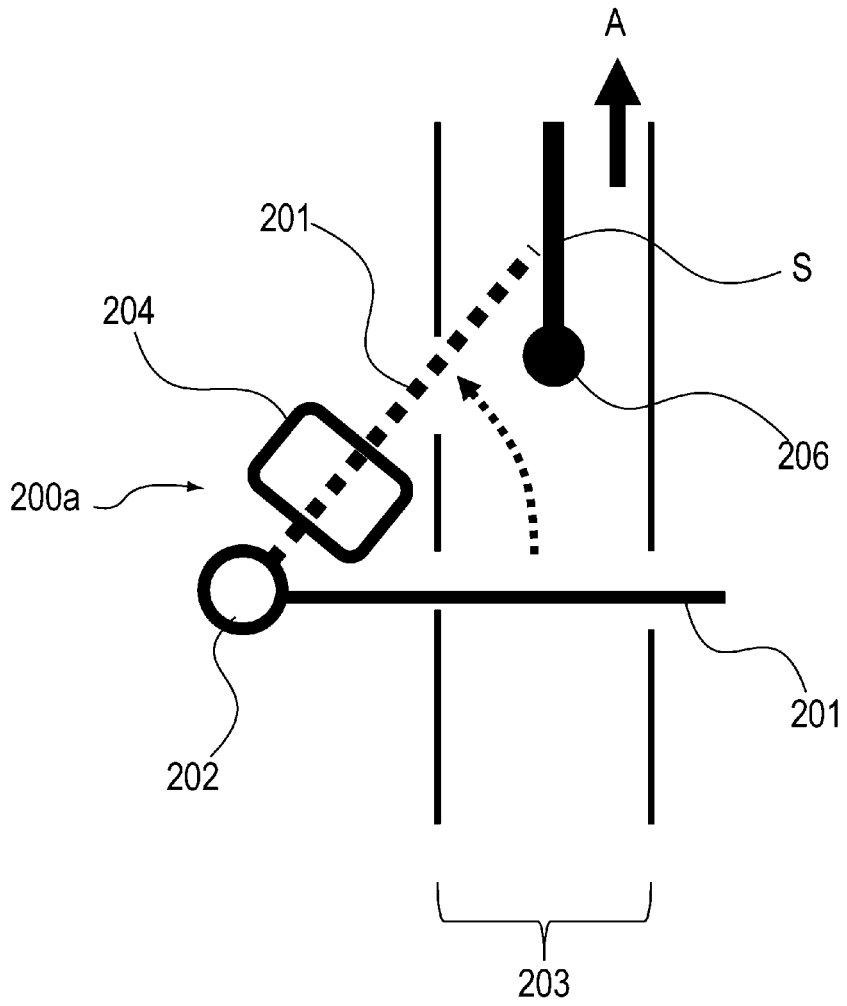
FIG. 4 is a schematic view for illustrating an operation of a feeding sensor.

Next, with reference to FIG. 4, a structure of the feeding sensor 200*a* will be described. FIG. 4 is a schematic view for illustrating an operation of the feeding sensor 200*a*. The feeding sensor 200*a* shown in FIG. 4 includes the sensor arm 201 supported rotatably about the rotation shaft 202. The sensor arm 201 is held by an unshown urging portion such as a spring at a position, indicated by a solid line of FIG. 4, where the sensor arm 201 projects across a feeding path 203. The detecting portion 204 detects rotational movement of the sensor arm 201.

The recording material S nipped and fed by the registration roller pair 14 moves in the feeding path 203 in an arrow A direction of FIG. 4 and reaches the sensor arm 201 of the feeding sensor 200*a* projecting across the feeding path 203. Then, the sensor arm 201 is pushed and rotated about the rotation shaft 202 in the counterclockwise direction of FIG. 4 by the recording material S against an urging force of the unshown urging portion, and thus is moved to a position indicated by a broken line of FIG. 4.

The detecting portion 204 detects movement of the sensor arm 201 and sends a signal notifying the controller 400 of arrival of the recording material S at the feeding sensor 200*a*. Thereafter, the recording material S further moves in the feeding path 203 in the arrow A direction of FIG. 4, and when a trailing end portion 206 of the recording material S with respect to the traveling direction is spaced from the sensor arm 201, the sensor arm 201 is moved to a position indicated by a solid line of FIG. 4 by the urging force of the unshown urging portion.

The detecting portion 204 detects the movement of the sensor arm 201 and sends the signal notifying the controller 400 of arrival of the recording material S at the feeding sensor 200*a*. Further, as another constitution of the feeding sensor 200*a*, for example, a type in which a reflected wave is detected by irradiating the recording material S passing through the feeding path 203 with light or an ultrasonic wave can be used.

<Both (Double) Side Printing>

In the case where printing is carried out on both sides (surfaces) of the recording material S, as shown in FIG. 3, the flapper 300*a* is rotationally moved to a position indicated by a broken line of FIG. 3 until a leading end portion of the recording material S on which the toner image is formed on a first surface thereof with respect to the traveling direction passes through the fixing device 30. Further, the flapper 300*b* is rotationally moved to a position indicated by a solid line of FIG. 3.

Then, the recording material S discharged from the fixing device 30 is guided by the flapper 300*a* rotated to the position indicated by the broken line of FIG. 3 and is introduced to the reversing roller pair 51. Thereafter, the recording material S is nipped and fed in a direction in which the recording material S is sent in a leftward direction by normally rotating the reversing roller pair 51.

The recording material S is fed by the reversing roller pair 51 until the trailing end portion thereof passes through the feeding sensor 200*b*. Thereafter, the flapper 300*a* is rotated to the position indicated by the solid line of FIG. 3.

As a result, the second feeding path H2 in which the recording material S nipped by the reversing roller pair 51 is fed toward the both side feeding roller pair 61 is formed.

The 300*a* is provided at a merging portion 8 where a feeding path 7 in which the recording material S passed through the fixing device 30 (fixing portion) 30 is fed and the second feeding path H2 are merged with each other. The second feeding path H2 includes the merging portion 8. The merging portion 8 is provided upstream of the reversing roller pair (reversing portion) 51 and the detecting surface 71 of the image reading portion (detecting portion) 70 provided along the first feeding path H1.

Thereafter, the reversing roller pair 51 is once stopped in a state in which the recording material S is nipped therebetween, and then the reversing roller pair 51 is reversely rotated in a direction in which the recording material S is sent in a rightward direction. As a result, the recording material S is fed toward the both side feeding roller pair 61 through the second feeding path H2. The reversing roller pair 51 is constituted as a reversing portion where the feeding direction of the recording material S passed through the fixing device (fixing portion) 30 is reversed. Thereafter, the recording material S is nipped and fed by the both side feeding roller pair 61 toward the feeding roller pair 62 shown in FIG. 1.

As shown in FIG. 1, a feeding sensor 200*c* is provided downstream of the both side feeding roller pair 61. A sensor arm 200*c*1 of the feeding sensor 200*c* is pushed and rotated about a rotation shaft 200*c*2 by the recording material S against an urging force of an unshown urging portion and thus is moved to a position indicated by a broken line of FIG. 1. As a result, the feeding sensor 200*c* detects a time when the leading end portion of the recording material S with respect to the traveling direction passes through the feeding sensor 200*c*.

The controller 400 causes the respective image forming stations 20 to form a toner image, on the outer peripheral surface of the intermediary transfer belt 25, to be transferred onto a second surface (back surface) of the recording material S. Thereafter, rotation of the both side feeding roller pair 61 and the feeding roller pair 62 is temporarily stopped after a lapse of a predetermined time from passing of the leading end portion of the recording material S with respect to the traveling direction through the feeding sensor 200*c*, so that the leading end portion of the recording material S with respect to the traveling direction is nipped by the feeding roller pair 62. Thereafter, timing is adjusted so that the toner image on the outer peripheral surface of the intermediary transfer belt 25 and the recording material S coincide with each other at the secondary transfer nip N1, and the both side feeding roller pair 61 and the feeding roller pair 62 are rotated. As a result, the recording material S is fed to the registration roller pair 14.

Thereafter, the recording material S is fed to the secondary transfer nip at predetermined timing by the registration roller pair 14, and then at the secondary transfer nip N1, the toner image formed on the outer peripheral surface of the intermediary transfer belt 25 is transferred onto the second surface (back surface) of the recording material S. Thereafter, the recording material S is fed to the fixing device 30, and the toner image is heat-fixed on the second surface (back surface) of the recording material S by the fixing device 30. The recording material S discharged from the fixing device 30 is guided by the flapper 300*a* rotated to the position indicated by the solid line of FIG. 3 and is introduced to the discharging roller pair 41, so that the recording material S is nipped and fed by the discharging roller pair 41 and thus is discharged onto the discharge tray 42.

A re-feeding path 5 in which the both side feeding roller pair 51 is provided feeds again the recording material S reversed by the reversing roller pair (reversing portion) 51 to the image forming portion 6. As shown in FIG. 3, the first feeding path H1 and the second feeding path H2 are feeding paths which connect the reversing roller pair (reversing portion) 51 and the re-feeding path 5. In the case where the image printed on the recording material S is read by the image reading portion (detecting portion) 70, the recording material S is passed through the first feeding path H1 and is fed to the re-feeding path 5. On the other hand, in the case where the image printed on the recording material S is not read by the image reading portion (detecting portion) 70, the recording material S is passed through the second feeding path H2 and is fed to the re-feeding path 5.

<Reading Operation of Image Printed on Recording Material S>

In the case where the image on the recording material S immediately after the toner image is heat-fixed on the recording material S by the fixing device 30 is read, the recording material S is fed to the reversing roller pair 61 similarly as in the case where the toner image is printed on the above-described second surface (back surface) of the recording material S. Thereafter, the recording material S is fed so as to be fed in the leftward direction of FIG. 3 by normally rotating the reversing roller pair 51, and after a lapse of a predetermined time from passing of the trailing end portion of the recording material S with respect to the traveling direction through the feeding sensor 200*b*, rotation of the reversing roller pair 51 is stopped. Thereafter, the flapper 300*b* is rotated to the position indicated by the broken line of FIG. 3. As a result, the first feeding path H1 in which the recording material S is fed from the reversing roller pair 51 toward the both side feeding roller par 61 through the image reading portion 70 is formed.

The image reading portion 70 is constituted as a detecting portion for detecting predetermined information from the recording material S reversed by the reversing roller pair (reversing portion) 51. The image reading portion (detecting portion) 70 reads the information of the image formed in the recording material S. As shown in FIG. 3, the image reading portion (detecting portion) 70 and the fixing device (fixing portion) 30 are disposed at an overlapping position as seen in a vertical direction (up-down direction of FIG. 3). The recording material S fed in the first feeding path H1 by reversely rotating the reversing roller pair 51 and by being nipped by the reversing roller pair 51 passes through a side where the detecting surface 71 of the image reading portion (detecting portion) 70 faces the first feeding path H1.

As shown in FIG. 3, the image reading portion 70 is provided inside the image forming apparatus 1 at a position opposing the fixing device 30 while sandwiching the second feeding path H2 between itself and the fixing device 30. The detecting surface 71, provided on the image reading portion 70, for detecting the image information of the recording material S is disposed on the first feeding path H1 side. The bottom (surface) 72 provided on the image reading portion 70 on a side opposite from the detecting surface 71 is disposed so as so be exposed to the second feeding path H2 side. The recording material S fed in the second feeding path H2 by reversely rotating the reversing roller pair 51 and by being nipped by the reversing roller pair 51 passes through the bottom 72 side which is a second surface side opposite from the detecting surface 71 side of the image reading portion (detecting portion) 70.

The reversing roller pair 51 nipping the recording material S is temporarily stopped, and thereafter is reversely rotated in a direction in which the recording material S is fed in the rightward direction of FIG. 3. As a result, the recording material S is guided by the flapper 300*b* rotated to the position indicated by the broken line of FIG. 3 and thus is introduced into the first feeding path H1, so that the recording material S is fed toward the both side feeding roller pair 61 via the detecting surface 71 of the image reading portion 70.

At this time, the image reading portion 70 reads at the detecting surface 71 thereof the image printed on the recording material S which is fed in the first feeding path H1 while being nipped by the reversing roller pair 51 reversely rotated. The image information printed on the recording material S and read by the image reading portion 70 is subjected to a process such as image feature extraction or the like by the controller 400. The controller 400 carries out evaluation of a printed image, adjustment of an image forming condition and the like by using information acquired from these. Further, the image information printed on the recording material S and read by the image reading portion 70 can be stored in an unshown memory provided in the image forming apparatus 1 or in an unshown electronic storing portion of a personal computer or the like on a network.

<Image Reading Portion>

Figure 5:
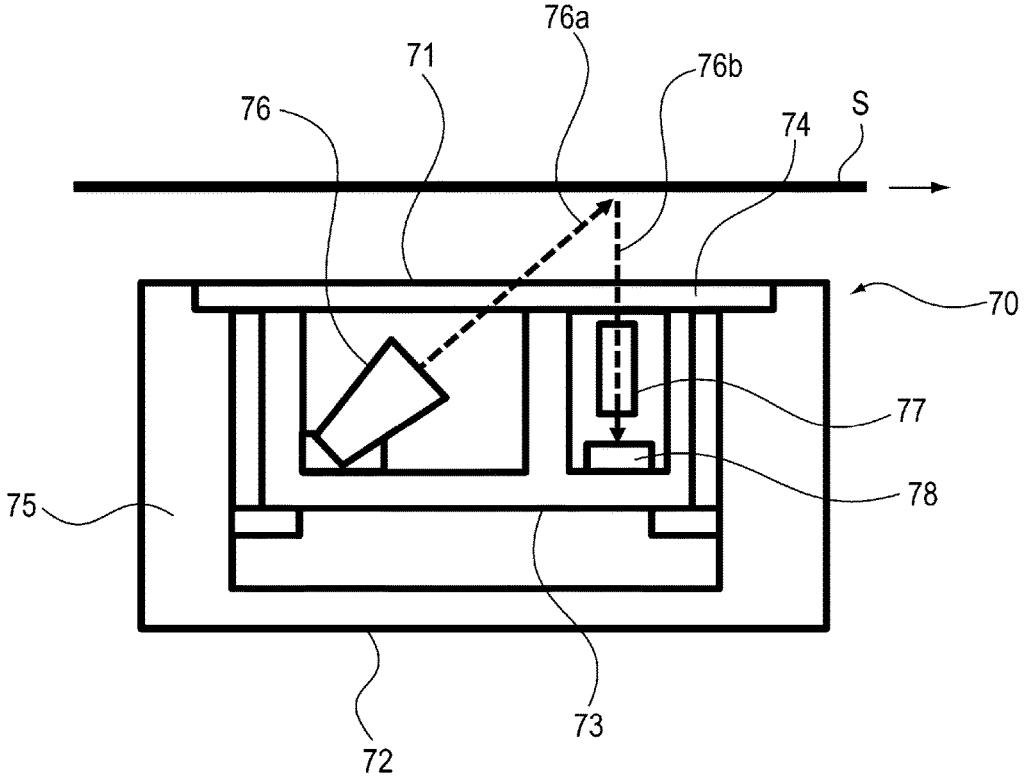
FIG. 5 is a sectional view showing a structure of the image reading portion.

Next, using FIG. 5, a structure of the image reading portion 70 will be described. FIG. 5 is a schematic view showing the structure of the image reading portion 70. The image reading portion 70 shown in FIG. 5 is constituted by including a detecting element 73, a contact glass 74 and a cover 75. The image reading portion 70 in this embodiment is constituted by a contact image sensor (CIS).

The detecting element 73 is constituted by including a plurality of light sources 76, a plurality of lenses 77 and a plurality of sensors 78 which are arranged in a widthwise direction (a vertical direction to the drawing sheet of FIG. 5) perpendicular to a feeding direction of the recording material S fed in the first feeding path H1 at a certain speed while being nipped by the feeding roller pair 51 to be reversely rotated.

By turning the light source 76 on and off at a certain cyclic period, the recording material S is irradiated with light 76*a* every certain time. As a result, as shown by a broken line of FIG. 5, reflected light 76*b* with intensity depending on a reflectance of a surface of the recording material S opposing the detecting surface 71 is incident on an optical sensor 78 through the lens 77. The optical sensor 78 generates an electric signal depending on intensity of the reflected light 76*b* which is incident on the optical sensor 78. Further, electric signals of the respective sensors 78 are processed by an unshown processing circuit. As a result, the image information of the recording material S can be acquired.

The contact glass 74 protects the detecting element 73 from directly contacting the recording material S which is fed in the first feeding path H1 by being nipped by the reversing roller pair 51 reversely rotated. A surface of the contact glass 74 opposing the first feeding path H1 is constituted as the detecting surface 71 of the image reading portion 70. The cover 75 is constituted in a shape covering a periphery of the detecting element 73 so that a dust or the like is not deposited on the detecting element 73. Further, the cover 75 supports the detecting element 73 and the contact glass 74 so as to keep a distance between the detecting element 73 and the contact glass 74 at a certain value. Another surface of the cover 75 on a side opposite from a side where the cover 75 supports the contact glass 74 is constituted as the bottom (surface) 72.

<Cooling of Image Reading Portion>

Next, a structure for cooling the image reading portion 70 will be described using FIGS. 3, 6 to 9 and 12. Part (a) of FIG. 6 is a front view showing a structure of the feeding guide 63. Part (b) of FIG. 6 is a sectional view showing the structure of the feeding guide 63. FIG. 7 is a perspective view showing a structure of the guiding rib 101 disposed on the bottom 72 of the image reading portion 70 in this embodiment. FIG. 8 is a sectional view showing the guiding rib 101 disposed on the bottom 72 of the image reading portion 70 in this embodiment and an air flow P for cooling (cooling air flow).

FIG. 9 is a sectional view showing a cooling air flow P in a comparison example in which the guiding rib 101 is not disposed on the bottom of the image reading portion 70. FIG. 11 is a perspective view showing a structure of a guiding plate 102 provided over the bottom 72 of the image reading portion 70. FIG. 10 is a sectional view showing the guiding plate 102 disposed over the bottom 72 of the image reading portion 70 in this embodiment and the cooling air flow P. FIG. 12 is a graph showing cooling efficiency of the image reading portion 70 in each of the case where the guiding rib 101 is disposed on the bottom 72 of the image reading portion 70 in this embodiment ("GUIDE RIB"), the case where the guiding plate 102 is disposed on the bottom 72 ("GUIDE PLATE") and the case where the guiding rib 101 and the guiding plate 102 are not disposed on the bottom 72 ("NO RIB & GUIDE PLATE").

In FIG. 3, inside the image forming apparatus 1, a cooling fan 112 which is an air flow generating portion for generating the cooling air flow P is provided. The cooling fan 112 sucks external air of the image forming apparatus 1 through an unshown opening. At a part of the feeding guide 63 forming the first feeding path H1, the opening 64 is provided. An air blowing opening 112*a* of the cooling fan 112 and the opening 64 are connected by a duct 111, so that these openings communicate with each other via the duct 111.

The external air of the image forming apparatus 1 is sucked by the cooling fan (air flow generating portion) 112. As a result, the generated cooling air flow P is guided from the air blowing opening 112*a* of the cooling fan 112 into the first feeding path H1 through the opening 64 of the feeding guide 63 via the duct 111. Thereafter, the air flow P is supplied toward the bottom 72 of the image reading portion 70 through a second opening provided at a position opposing the opening 64 of the feeding guide 63. The second opening is formed by the bottom 72 of the image reading portion 70, side surfaces of the respective guiding ribs 101 which are shown in FIG. 7, and the recording material S contactable and slidable with lower ends of the guiding ribs 101.

The cooling air flow P generated by the cooling fan (air flow generating portion) 112 is guided from the first feeding path H1 toward the second feeding path H2 through the second opening.

As shown in part (a) of FIG. 6, at a part of the feeding guide 63 forming the first feeding path H1, a plurality of openings 64 are provided. Guiding ribs (second guiding rib) 65 are provided so as to project relative to an inner surface of the feeding guide 63. The plurality of openings 64 are provided along a direction (the widthwise direction of the recording material S) perpendicular to the traveling direction (a direction from above toward below in part (a) of FIG. 6) of the recording material S to be guided by the guiding ribs 65.

The openings 64 are formed in a slit shape such that each of the openings 64 extends in the up-down direction. Each opening 64 is provided so that a longitudinal direction (the up-down direction of part (a) of FIG. 6) thereof extends along the traveling direction (the direction from above toward below in part (a) of FIG. 6) of the recording material S. With respect to the vertical direction (the up-down direction of part (a) of FIG. 3) shown in FIG. 3, the openings 64 are provided between the image reading portion (detecting portion) 70 and the fixing device (fixing portion) 30.

Here, the case where the image reading portion (detecting portion) 70, the openings 64 and the fixing device (fixing portion) 30 are arranged in a named order from above in the up-down direction of FIG. 1 will be considered. At this time, positioning of the openings 64 between the image reading portion (detecting portion) 70 and the fixing device (fixing portion) 30 means that upper surfaces of the openings 64 are not positioned on an upper side above an upper surface of the image reading portion (detecting portion) 70 and that lower surfaces of the openings 64 are not positioned on a lower side below a lower surface of the fixing device (fixing portion) 30.

The openings 64 are formed with predetermined pitches along a direction (a left-right direction of part (a) of FIG. 6) perpendicular to the feeding direction of the recording material S passing through the first feeding path H1. Between the adjacent openings 64, the guiding rib (second guiding rib) 65 which stands from the inner surface of the feeding guide 63 and which guides the recording material S is provided. The guiding rib 65 is provided so as to project toward the inside of the first feeding path H1.

At the bottom 72 of the image reading portion 70, as shown in FIG. 7, the guiding ribs 101 which are (air) flow path forming portions which extend along the feeding direction of the recording material S passing through the second feeding path H2 and which project toward the inside of the second feeding path H2 are provided. The guiding ribs (flow path forming portions) 101 stand from the bottom (second surface) 72 of the image reading portion (detecting portion) 70 and guide the recording material S.

The guiding ribs 101 are provided so that a longitudinal direction thereof extends along the traveling direction of the recording material S passing through the second feeding path H2. As a result, the cooling air flow P can be supplied along the second feeding path H2. The guiding ribs 101 are formed at a plurality of positions with predetermined pitches along a direction (a left-right direction of FIG. 7) perpendicular to the feeding direction of the recording material S passing through the second feeding path H2.

The guiding ribs 101 form a flow path 4, between themselves and the recording material S passing through the second feeding path H2, in which the air flow P for cooling the bottom 72 of the image reading portion 70 is passed.

When the recording material S passes through the second feeding path H2, the guiding ribs 101 form the flow path 4, for passing the air flow P therein, between the recording material S passing through the second feeding path H2 and a constituent portion constituting the second feeding path H2 on the image reading portion (detecting portion) 70 side. The constituent portion constituting the second feeding path H2 on the image reading portion (detecting portion) 70 side is constituted by the bottom 72 of the image reading portion 70 and the guiding ribs 101. The guiding ribs (flow path forming portions) 101 guide the recording material S passing through the second feeding path H2.

A height h of the guiding ribs 101 projecting from the bottom 72 of the image reading portion 70 will be considered. The height h may preferably be such that a space enough to pass the cooling air flow P through between the recording material S and the bottom 72 of the image reading portion 70 can be ensured.

The guiding rib (flow path forming portion) 101 forms a space for passing the cooling air flow P through between the recording material S fed through the second feeding path H2 and the bottom (second surface) 72 of the image reading portion 70. The guiding rib 101 guides the recording material S passing through the second feeding path H2.

The cooling air flow P is blown toward the image reading portion 70 through the openings 64 provided in the feeding guide 63 of the first feeding path H1. Thereafter, the cooling air flow P flows along the guiding rib 101 provided on the bottom 72 of the image reading portion 70 shown in FIG. 7 in a direction opposite to the feeding direction of the recording material S shown in an arrow A1 direction of FIG. 1 in the second feeding path H2. The air flow P passed through the bottom 72 of the image reading portion 70 along the guiding rib 101 flows in directions of the discharging roller pair 41 and the reversing roller pair 51.

<Cooling Efficiency of Image Reading Portion>

In the case where the images are printed on both sides (both surfaces) of the recording material S by the image forming apparatus 1, a time for the recording material S to pass through the second feeding path H2 is increased. As shown in a comparison example of FIG. 9, in the case where the guiding rib 101 does not exist on the bottom 72 of the image reading portion 70, the recording material S passing through the second feeding path H2 directly contacts the bottom 72 of the image reading portion 70. As a result, the flow path 4 in which the cooling air flow P blown toward the image reading portion 70 through the opening 64 provided in the feeding guide 63 of the first feeding path H1 passes through the bottom 72 of the image reading portion 70 is narrowed by the recording material S.

The flow path 4 in which the cooling air flow P passes along the bottom 72 of the image reading portion 70 is narrowed by the recording material P, whereby efficiency of discharging heat resulting from the cooling air flow P warmed at a periphery of the image reading portion 70 by the fixing device 30 is reduced, so that cooling efficiency of the image reading portion 70 lowers.

On the other hand, as shown in FIG. 8, the case where the guiding rib 101 is provided on the bottom 72 of the image reading portion 70 will be considered. In this case, the flow path 4 in which the cooling air flow P passes along the bottom 72 is ensured between the recording material S passing through the second feeding path H2 and the bottom 72 of the image reading portion 70 by the guiding rib 101.

The flow path 4 in which the cooling air flow P passes along the bottom 72 of the image reading portion 70 is ensured, whereby compared with the case where the guiding rib 101 does not exist on the bottom 72 of the image reading portion 70 as in the comparison example as shown in FIG. 9, the cooling efficiency of the image reading portion 70 can be maintained in a high state.

<Cooling Efficiency of Image Reading Portion by Guiding Rib>

Next, cooling efficiency of the image reading portion in the case where the guiding rib 101 is disposed on the bottom 72 of the image reading portion 70 in this embodiment will be described using FIG. 12. The image forming apparatus 1 in which the guiding rib 101 is disposed on the bottom 72 of the image reading portion 70 as shown in FIG. 8 and the image forming apparatus 1 in which the guiding rib 101 is not disposed on the bottom 72 of the image reading portion 70 as shown in FIG. 9 will be considered. Both the image forming apparatuses 1 are used, and both side printing of the images on 1000 sheets of the recording material S at a printing speed of 40 sheets/min is carried out with respect to a direction in which a longitudinal direction of an A4-size recording material S is parallel to the sheet feeding direction. Then, a temperature change amount of the image reading portion 70 between a time of a start of the printing and a time of an end of the printing was measured for each of the image forming apparatuses 1.

A height h of the guiding rib 101 projecting from the bottom 72 of the image reading portion 70 was 3 mm. A bar ("GUIDE RIB") shown at a central portion of a bar graph of FIG. 12 is a result of the temperature change amount of the image reading portion 70 in the case where the guiding rib 101 is disposed on the bottom 72 of the image reading portion 70. Further, a bar ("NO RIB & GUIDE PLATE") shown on a right-hand side of the bar graph of FIG. 12 is a result of the temperature change amount of the image reading portion 70 in the case where the guiding rib 101 is not disposed on the bottom 72 of the image reading portion 70.

As shown in FIG. 12, the image forming apparatus 1 in which the guiding rib 101 is disposed on the bottom 72 of the image reading portion 70 will be considered. Further, the image forming apparatus 1 in which the guiding rib 101 is not disposed on the bottom 72 of the image reading portion 70 will be considered. The image forming apparatus 1 in which the guiding rib 101 is disposed was capable of suppressing the temperature change amount of the image reading portion 70 so as to be lower than that of the image forming apparatus 1 in which the guiding rib 101 is not disposed, by 5.2° C. (=34.1° C.−28.9° C.).

In this embodiment, the guiding rib 101 was disposed on the bottom 72 of the image reading portion 70. As a result, the temperature of the image reading portion 70 can be maintained at a low temperature by efficiently cooling the bottom 72 of the image reading portion 70 by the cooling air flow P sent from the cooling fan 112 through the duct 111 and the opening 64 provided in the feeding guide 63.

<Cooling of Image Reading Portion by Guiding Plate>

The flow path 4 of the cooling air flow P passing through the bottom 72 of the image reading portion 70 shown in FIG. 8 can also be formed by providing the guiding plate 102 with a predetermined gap from the bottom 72 of the image reading portion 70 as shown in FIGS. 10 and 11. FIG. 10 is a sectional view showing the guiding plate 102 disposed over the bottom 72 of the image reading portion 70 and the cooling air flow P. FIG. 11 is a perspective view showing a structure of the guiding plate 102 disposed over the bottom 72 of the image reading portion 70.

As shown in FIGS. 10 and 11, the guiding plate 102 is supported so as to ensure a predetermined space from the bottom 72 of the image reading portion 70 by a supporting member 103 standing from and provided on the bottom 72 of the image reading portion 70. The supporting member 103 is provided at a plurality of positions with predetermined pitches along a direction (a left-right direction of FIG. 11) perpendicular to the feeding direction of the recording material S passing through the second feeding path H2.

The guiding plate 102 forms the flow path 4 of the cooling air flow P passing through the bottom 72 of the image reading portion 70 similarly as in the case of the guiding rib 101 described above with reference to FIGS. 7 and 8.

The guiding plate (flow path forming portion) 102 forms the flow path 4 in which the air flow P is passed through between the recording material S passing through the second feeding path H2 and the constituent portion constituting the second feeding path H2 on the image reading portion 70 side (detecting portion side) when the recording material S passes through the second feeding path H2. The constituent portion constituting the second feeding path H2 on the image reading portion 70 side (detecting portion side) is constituted by the bottom 72 of the image reading portion 70 and the guiding plate 102. The guiding plate (flow path forming portion) 102 guides the recording material S passing through the second feeding path H2.

On a surface of the guiding plate 102 on a side where the recording material S passing through the second feeding path H2 is contactable to the guiding plate 102, a guiding rib 104 projecting from the surface and extending along the feeding direction of the recording material S is formed. The guiding rib 104 is formed at a plurality of positions with predetermined pitches along a direction (the left-right direction of FIG. 11) perpendicular to the feeding direction of the recording material S passing through the second feeding path H2.

The recording material S is slid and fed along the guiding rib 104 provided on the surface of the guiding plate 102 on the side where the recording material S is contactable to the guiding plate 102. As a result, a contact area between the recording material S and the guiding plate 102 becomes small. For this reason, not only a feeding resistance between the recording material S and the guiding plate 102 can be reduced but also a temperature rise of the guiding plate 102 due to conduction of heat of the recording material S warmed by the fixing device 30 to the guiding plate 102 can be reduced. As a result, a temperature rise of the image reading portion 70 over which the guiding plate 102 is provided can be reduced.

That is, the flow path forming portion shown in FIGS. 10 and 11 is constituted by the guiding plate 102 which is a plate-like member. The guiding plate 102 opposes the bottom (second surface) 72 of the image reading portion (detecting portion) 70 through the gap therebetween via the supporting member 103 standing from the bottom (second surface) 72 of the image reading portion (detecting portion) 70. The guiding plate (plate-like member) 102 guides the recording material S.

As shown in FIGS. 10 and 11, a part of the first feeding path H1 is provided with a second opening for permitting guidance of the air flow P, generated by the cooling fan (air flow generating portion) 112, from the first feeding path H1 to the second feeding path H2. The second opening is formed by the bottom 72 of the image reading portion 70 and the guiding plate 102.

An image forming apparatus 1 in which the guiding plate 102 is supported by the supporting member 103 provided on the bottom 72 of the image reading portion 70 was also subjected to an experiment in the same condition as that of the image forming apparatus 1 in which the above-described guiding rib 101 is disposed. As shown in FIG. 10, a closest distance G between the bottom 72 of the image reading portion 70 and the guiding plate 102 was 2 mm.

As shown by a bar ("GUIDE PLATE") on a left-hand side of the bar graph of FIG. 12, the image forming apparatus 1 in which the guiding plate 102 is supported by the supporting member 103 provided on the bottom 72 of the image reading portion 70 will be considered. Further, as shown by the bar ("NO RIB & GUIDE PLATE") on the right-hand side of the bar graph of FIG. 12, the image forming apparatus 1 in which the guiding plate 102 is not disposed over the bottom 72 of the image reading portion 70 will be considered. The image forming apparatus 1 provided with the guiding plate 102 was capable of suppressing the temperature change amount of the image reading portion 70 so as to be lower than that of the image forming apparatus 1 provided with no guiding plate 102 by 6.2° C. (=34.1° C.−27.9° C.).

In this embodiment, the guiding plate 102 was disposed over the bottom 72 of the image reading portion 70 via the supporting member 103. As a result, the temperature of the image reading portion 70 can be maintained at a low temperature by efficiently cooling the bottom 72 of the image reading portion 70 by the cooling air flow P sent from the cooling fan 112 through the duct 111 and the opening 64 provided in the feeding guide 63. As a result, cooling efficiency of the image reading portion 70 of the image forming apparatus 1 in which the image reading portion 70 for detecting image information on the recording material S immediately after the printed image is formed is provided can be improved.

Incidentally, in this embodiment, a constitution in which cooling of the image reading portion 70 of the image forming apparatus 1 in which the image reading portion 70 for detecting image information on the recording material S immediately after the printed image is formed is provided is carried out was described. As another example, instead of the image reading portion 70, a basis weight detecting portion for detecting a basis weight of the recording material S or a thickness detecting portion for detecting a thickness of the recording material S, which detecting portions are formed with electronic parts of which detection results are liable to be influenced by the temperature and which are shown in FIG. 13, can be used.

<Basis Weight Detecting Portion>

FIG. 13 is a side view showing a structure of an ultrasonic sending device 131*b* provided at a sending portion 131 of a basis weight detecting portion 130 and an ultrasonic receiving device 132*a* provided at a receiving portion 132 of the basis weight detecting portion 130. As shown in FIG. 13, the ultrasonic sending device 131*b* of the sending portion 131 mounted on an electrical substrate 131*a* and the ultrasonic receiving device 132*a* of the receiving portion 132 are provided opposed to each other via the first feeding path H1 in which the recording material S is fed.

The ultrasonic sending device 131*b* of the sending portion 131 and the ultrasonic receiving device 132*a* of the receiving portion 132 which are shown in FIG. 13 are similarly constituted by including a piezoelectric element which is an interconversion element between mechanical displacement and an electric signal and including an electrode terminal. In the ultrasonic sending device 131*b* of the sending portion 131, a pulse voltage with a predetermined frequency is inputted into the electrode terminal. Then, the piezoelectric element oscillates, so that ultrasonic wave is generated and transmitted in the air. When the ultrasonic wave sent from the ultrasonic sending device 131*b* of the sending portion 131 reaches the recording material S fed in the first feeding path H1, the recording material S is ultrasonically vibrated by the ultrasonic wave.

The ultrasonic wave sent from the ultrasonic sending device 131*b* of the sending portion 131 is received by the ultrasonic receiving device 132*a* of the receiving portion 132 via the recording material S. The piezoelectric element provided in the ultrasonic receiving device 132*a* generates, depending on a basis weight (weight per unit area (g/m$^2$) of the recording material S), an output voltage depending on amplitude of the received ultrasonic wave, on the electrode terminal.

The basis weight of the recording material S is detected by the controller 400 on the basis of the output voltage generation on the electrode terminal of the ultrasonic receiving device 132*a*. A relationship between the basis weight of the recording material S and the output voltage generating on the electrode terminal of the ultrasonic receiving device 132*a* is stored in advance in an unshown storing portion. As a result, the controller 400 is capable of detecting the basis weight of the recording material S on the basis of the output voltage generating on the electrode terminal of the ultrasonic receiving device 132*a*.

On a bottom 130*a* of such a basis weight detecting portion 130, the guiding rib 101 as shown in FIGS. 7 and 8 or the guiding plate 102 as shown in FIGS. 10 and 11 is provided. As a result, cooling efficiency of the basis weight detecting portion 130 of the image forming apparatus 1 in which the basis weight detecting portion 130 for detecting the basis weight of the recording material S immediately after the printed image is formed can be improved.

<Thickness Detecting Portion>

The temperature of the recording material S can be detected using a constitution similar to that of the basis weight detecting portion 130 described above with reference to FIG. 13. An ultrasonic signal, such as an impulse signal, having a short duration of time is sent from the ultrasonic sending device 131*b* of the sending portion 131 and is received by the ultrasonic receiving device 132*a* of the receiving portion 132 via the recording material S.

The ultrasonic signal received by the ultrasonic receiving device 132*a* includes two kinds of signals consisting of an ultrasonic signal U1 which passes through the recording material S without being reflected at least one time in the recording material S and an ultrasonic signal U2 which passes through the recording material S after being reflected once at each of a front surface and a back surface of the recording material S. A difference between a time when the ultrasonic signal U1 reaches the ultrasonic receiving device 132*a* and a time when the ultrasonic signal U2 reaches the ultrasonic receiving device 132*a* is equal to a time required for passing of the ultrasonic wave in a distance which is twice the thickness of the recording material S. For this reason, the thickness of the recording material S can be calculated using a speed of the ultrasonic wave passing through the recording material S. Specifically, in the controller 400, the thickness of the recording material S is detected by making reference to the speed of the ultrasonic wave, passing through the recording material S, stored in advance in the unshown storing portion.

On a bottom (130*a*) of such a thickness detecting portion (130), the guiding rib 101 as shown in FIGS. 7 and 8 or the guiding plate 102 as shown in FIGS. 10 and 11 is provided. As a result, cooling efficiency of the thickness detecting portion (130) of the image forming apparatus 1 in which the thickness detecting portion (130) for detecting the thickness of the recording material S immediately after the printed image is formed can be improved.

Here, various pieces of the information relating to the recording material S immediately after the printed image is formed on the recording material S include not only information such as a color, a pattern or a printing position of the image to be printed on the recording material S but also information indicating a characteristic of the recording material S itself, such as a color or glossiness of the recording material S itself, a copy-forgery-inhibited pattern, a thickness or a basis weight of the recording material S. On the basis of a detection result of these pieces of information by the detecting portion, various image forming operations can be controlled. Incidentally, as an example of the image forming apparatus 1, as shown in FIG. 1, an example in the case where the present invention is applied to a full-color laser beam printer including a plurality of photosensitive drums 21 was described. In addition, the present invention is also applicable to a monochromatic copying machine or printer including a single photosensitive drum 21.

Second Embodiment

Next, a structure of an image forming apparatus according to the present invention in a Second Embodiment will be described using FIGS. 14 and 15. Incidentally, constituent elements similar to those in the First Embodiment described above will be omitted from description by adding the same reference numerals or symbols or by adding the same member (portion) names even when the reference numerals or symbols are different from those in the First Embodiment. FIG. 14 is a sectional view showing a structure of an image forming apparatus 1 in this embodiment. FIG. 15 is a partially enlarged view of FIG. 14, showing a structure of a periphery of an image reading portion 70 in this embodiment.

In the image forming apparatus 1 in the First Embodiment described above with reference to FIG. 1, the constitution in which the printed image formed on the recording material S is read by the image reading portion 70 was employed. In the image forming apparatus 1 in this embodiment shown in FIG. 14, an overwriting printing function on an original image of an original D is added.

<Feeding and Discharging Tray of Original>

As shown in FIG. 14, above the manually feeding tray 3 of the image forming apparatus 1, an original detecting tray 81 is provided. Further, above the discharge tray 42, an original discharge tray 92 is provided. By employing such a constitution, an access direction when a user stacks originals D on the original feeding tray 81 and an access direction when the user stacks the recording materials S on the manually feeding tray 3 are unified into the same direction. Further, an access direction when the user removes the original D discharged on the original discharge tray 92 and an access direction when the user removes the recording material S discharged on the discharge tray 42 are unified into the same direction. As a result, these trays are arranged so as to be easy-to-use for the user.

The originals D stacked on the original discharge tray 81 are separated and fed one by one from below by an original separation roller pair 83. Thereafter, a leading end of the original D is abutted against the nip of an original registration roller pair 84 at rest, so that an oblique movement of the original D is corrected. Thereafter, the original D is nipped and fed downstream by the original registration roller pair 84. The original separation roller pair 83 and the original registration roller pair 84 are constituted as an original feeding portion for feeding the original D to image reading portions (detecting portions) 70*a* and 70*b*.

<Regarding and Printing of Original Image>

The original D is stacked on the original feeding tray 81 shown in FIG. 15. Then, a sensor arm 82*a* of an original detecting sensor 82 provided in the original feeding tray 81 is pushed by the original D against an urging force of an unshown urging portion, so that the sensor arm 82*a* is rotated about a rotation shaft 82*b* in the counterclockwise direction. As a result, the sensor arm 82*a* is moved to a position indicated by a broken line of FIG. 15. As a result, the controller 400 detects that the original D exists on the original feeding tray 81 on the basis of a detection result of the original detecting sensor 82.

Thereafter, the controller 400 drives an unshown driving portion such as a solenoid, so that a flapper 300*c* is rotated to a position indicated by a broken line of FIG. 15. Further, the controller 400 drives an unshown driving portion such as the solenoid, so that a flapper 300*d* is rotated to a position indicated by a broken line of FIG. 15.

<Third Feeding Path>

As shown in FIG. 15, a third feeding path H3 is provided between the original feeding tray 81 and the image reading portions (detecting portions) 70*a* and 70*b*. The third feeding path H3 is constituted by including feeding guides 16 and 17, the original separation roller pair 83, the original registration roller pair 84, the flapper 300*c*, an upper portion of the guiding rib 101, and the like. The third feeding path H3 connects the original separation roller pair 83 and the original registration roller pair 84 which are an original feeding portion with the image reading portions (detecting portion) 70*a* and 70*b*. The original D nipped and fed in the third feeding path H3 by the original registration roller pair 84 is guided by the flapper 300*c* and is fed toward the image reading portions 70*a* and 70*b*.

<Fourth Feeding Path>

As shown in FIG. 15, a fourth feeding path H4 is provided between an original discharging roller pair 91 and the image reading portions (detecting portions) 70*a* and 70*b*. The third feeding path H3 is constituted by including the upper portion of the guiding rib 101, the flapper 300*d*, feeding guides 18 and 19, and the like. The fourth feeding path H4 connects the image reading portions (detecting portion) 70*a* and 70*b* with the original discharging roller pair (original discharging portion) 91. The original D nipped and fed in the fourth feeding path H4 by the original registration roller pair 84 is guided by the flapper 300*d* and is fed toward the original discharging roller pair 91. The original discharging roller pair 91 is constituted as an original discharging portion for discharging the original D passed through the image reading portions (detecting portion) 70*a* and 70*b*, onto the original discharge tray 92.

A sensor arm 200*d*1 of a feeding sensor 200*d* provided on the fourth feeding path H4 is constituted so as to be rotatable about a rotation shaft 200*d*2 in the clockwise direction and the counterclockwise direction of FIG. 15 depending on a traveling direction of the original D. As a result, the sensor arm 200*d*1 of the feeding sensor 200*d* does not impair the original D fed in the fourth feeding path H4.

The original D nipped and fed by the original registration roller pair 84 is passed through between the image reading portions 70*a* and 70*b* and then is nipped and fed by the original discharging roller pair 91. Thereafter, the original D is discharged onto the original discharge tray 92. When there is no original D on the original feeding tray 81, the sensor arm 82*a* of the original detecting sensor 82 is urged by the unshown urging portion and is rotated about the rotation shaft 82*b* in the clockwise direction of FIG. 15 and is moved to a position indicated by a solid line of FIG. 15.

As a result, on the basis of a detection result of the original detecting sensor 82, the controller 400 detects that the original D does not exist on the original feeding tray 81. Thereafter, rotation of the original separation roller pair 83 and the original registration roller pair 84 is stopped, and after a lapse of a predetermined time, the flapper 300*c* is rotated in the clockwise direction of FIG. 15 and thus is moved to a position indicated by a solid line of FIG. 15. Incidentally, a similar operation may also be performed after feeding of the originals D in the number of sheets designated by the user is ended.

The two image reading portions 70*a* and 70*b* are disposed so that detecting surfaces 71*a* and 71*b* for reading original images oppose a front surface and a back surface, respectively, of the original D when the original D passes through the third feeding path H3 and the fourth feeding path H4 in the image forming apparatus 1. The two image reading portions 70*a* and 70*b* are disposed opposed to each other, whereby the original images on the front and back surfaces of the original D passing through the image reading portions 70*a* and 70*b* can be read at once.

When there is no need to read the original images on the front and back surfaces of the original D at once, either one of the image reading portions 70*a* and 70*b* may also be disposed. The image reading portions 70*a* and 70*b* start a reading operation after a lapse of a predetermined time from passing of a leading end of the original D through a feeding sensor 200*e*. Then, the reading operation is ended after a lapse of a predetermined time from the passing of a trailing end of the original D through the feeding sensor 200*e*.

The original images of the original D read by the image reading portions 70*a* and 70*b* are stored as electronic information in a personal computer or the like on a network with which the image forming apparatus 1 is connected. Or, the original images are sent to the controller 400 and are converted to printed image information by the controller 400, so that the original images are printed on the recording material S.

<Overwriting Printing onto Original>

Next, using FIG. 15, an operation in which the image information of the original D is read by the image reading portions 70*a* and 70*b* and in which a printing image corresponding to the image information of the original D is overwritten and printed on the original D will be described. The original D is placed on the original feeding tray 81 so that an overwriting printing surface of the original D is oriented upwardly in FIG. 15. Thereafter, similarly as in the above-described reading operation of the original images, the original D is fed through between the image reading portions 70*a* and 70*b*, so that the image information of the original D is read.

The controller 400 shown in FIG. 14 prepares printing image information to be overwritten and printed on the original D on the basis of the image information of the original D read by the image reading portion 70*b*. After a lapse of a predetermined time after passing of the trailing end of the original D with respect to the traveling direction of the recording material S through the feeding sensor 200*d*, the flapper 300*c* is rotated in the clockwise direction of FIG. 15 and thus is moved to the position of the solid line of FIG. 15. At the same time, rotation of the original discharging roller pair 91 nipping the original D is stopped.

Thereafter, the controller 400 is reversely rotated in a direction in which the original D is fed in a rightward direction of FIG. 15. The original discharging roller pair (original discharging portion) 91 also functions as a second reversing portion for reversing the feeding direction of the original D passed through between the image reading portions (detecting portion) 70*a* and 70*b*. As a result, the original D is passed through between the image reading portions 70*a* and 70*b* and is guided by the flapper 300*c*, so that the original D is introduced into the first feeding path H1 and then is nipped and fed by the both side feeding roller pair 61.

Thereafter, similarly as in the printing of the image on the second surface (back surface) of the recording material S in the First Embodiment, the printing image corresponding to the image information of the original D is overwritten and printed on the original D. At this time, the original D subjected to overwriting printing is constituted as a recording material. The original D discharged from the fixing device 30 is guided by the flappers 300*a* and 300*d* and is sent to the original discharging roller pair 91 in a state in which the flappers 300*a* and 300*d* are rotated to the positions indicated by the broken lines of FIG. 15. Then, the original D is nipped and fed by the original discharging roller pair 91 and then is discharged onto the original discharge tray 92.

<Reading Operation of Image Information of Recording Material S>

In the case where the image on the recording material S immediately after the toner image is heat-fixed by the fixing device 30 is read the flapper 300*a* is rotated in the clockwise direction of FIG. 15 and thus is moved to the position indicated by the broken line of FIG. 15 until the leading end of the recording material S with respect to the traveling direction of the recording material S passes through the fixing device 30. Further, the flapper 300*d* is rotated in the clockwise direction of FIG. 15 and thus is moved to the position indicated by the broken line of FIG. 15. Thereafter, the controller 400 causes the original discharging roller pair 91 to be normally rotated in a direction in which the recording material S is fed in a leftward direction of FIG. 15. The controller 400 causes the original discharging roller pair 91 to be rotated until the trailing end of the recording material S with respect to the traveling direction of the recording material S passes through a feeding sensor 200*f* and then stops rotation of the original discharging roller pair 91.

The feeding sensor 200*f* shown in FIG. 15 is constituted, similarly as the feeding sensor 200*e*, so that a sensor arm 200*f*1 is rotatable about a rotation shaft 200*f*2 in the clockwise direction and the counterclockwise direction of FIG. 15. The controller 400 rotates the flapper 300*a* in the counterclockwise direction and thus moves the flapper 300*a* to a position indicated by a solid line of FIG. 15. Further, the controller 400 rotates the flapper 300*d* in the counterclockwise direction and thus moves the flapper 300*a* to a position indicated by a solid line of FIG. 15.

As a result, the first feeding path H1 is formed. When the original discharging roller pair 91 nipping the recording material S is reversely rotated, the recording material S is passed through between the image reading portions 70*a* and 70*b*, so that the image information of the recording material S can be read by the image reading portions 70*a* and 70*b*. Thereafter, the recording material S is guided by the flapper 300*c* in an attitude position indicated by the solid line of FIG. 15 and thus is fed to the both side feeding roller pair 61. As shown in FIG. 15, the first feeding path H1 connects the original discharging roller pair (original discharging portion) 91 and the re-feeding path 5.

<Both Side Printing of Recording Material S>

In the case where both side printing is carried out without reading the image information of the recording material S by the image reading portions 70*a* and 70*b*, the controller 400 rotates the flapper 300*a* in the counterclockwise direction and thus moves the flapper 300*a* to the position indicated by the broken line of FIG. 15. Further, the controller 400 rotates the flapper 300*d* in the counterclockwise direction and thus moves the flapper 300*d* to the position indicated by the broken line of FIG. 15. As a result, the recording material S discharged from the fixing device 30 is guided by the flappers 300*a* and 300*d* and thus is fed to the guide roller pair 51.

When the reversing roller pair 51 nipping the recording material S is reversely rotated, the second feeding path H2 in which the recording material S is fed toward the both side feeding roller pair 61 is formed. The second feeding path H2 connects the reversing roller pair (reversing portion) 51 and the re-feeding path 5. Thereafter, the reversing roller pair 51 nipping the recording material S is reversely rotated in a direction in which the recording material S is fed in a rightward direction of FIG. 15. As a result, the recording material S is passed through the second feeding path H2 and thus is fed to the both side feeding roller pair 61. Other operations are similar to the image information reading operation and the both side printing operation of the recording material S in the First Embodiment, and therefore, redundant explanation thereof will be omitted.

Of thermal sources causing temperature rise of the image reading portions 70*a* and 70*b* shown in FIG. 14, influences of heat generating at the fixing device 30 and heat accumulated in the recording material S immediately after passing through the fixing device or in the original D immediately after passing through the fixing device 30 are largest.

The cooling air flow P is passed immediately under the bottom 72 of the lower image reading portion 70*b* shown in FIG. 14, whereby most of air increased in temperature by the heat generated at the fixing device 30 and by the heat accumulated in the recording material S or the original D immediately after passing through the fixing device 30 is discharged to an outside of the image forming apparatus 1. As a result, temperature rise of the upper image reading portion 70*a* of FIG. 14 due to the heat generated at the fixing device 30 and the heat obtained by conduction, through the air, of the heat accumulated in the recording material S or the original D immediately after passing through the fixing device 30 is smaller than temperature rise of the lower image reading portion 70*b*.

Between the upper image reading portion 70*a* in FIG. 4 and the heat source comprising the fixing device 30 or the heat source such as the heat accumulated in the recording material S or the original D immediately after passing through the fixing device 30, various component parts are disposed. The various component parts include the lower image reading portion 70*b* and the guiding rib 101 in FIG. 14, the guiding plate 102 similar to that shown in FIGS. 10 and 11, or the flapper 300*b* shown in FIGS. 7 and 10, and the like.

For this reason, the heat radiated from the heat source comprising the fixing device 30 or the heat source such as the heat accumulated in the recording material S or the original D immediately after passing through the fixing device 30 is absorbed by the various component parts. Further, in FIG. 14, the upper image reading portion 70*a* is disposed at a position remoter from the heat source comprising the fixing device 30 or the heat source such as the heat accumulated in the recording material S or the original D immediately after passing through the fixing device 30 than the lower image reading portion 70*b* is. For this reason, temperature rise of the upper image reading portion 70*a* in FIG. 14 due to the heat radiated from the heat source comprising the fixing device 30 or the heat source such as the heat accumulated in the recording material S or the original D immediately after passing through the fixing device 30 is smaller than temperature rise of the lower image reading portion 70*b* in FIG. 14. For this reason, for the upper image reading portion 70*a* in FIG. 14, there is no need to blow the cooling air flow P toward the upper image reading portion 70*a*.

In this embodiment, in addition to an effect obtained in the above-described First Embodiment, the image on the original D can be read and copied on the recording material S, and further the image on the original D can be subjected to overwriting printing onto the original D. As a result, it is possible to cool the detecting portion for detecting predetermined information from the recording material S (including the original D) without causing upsizing of the image forming apparatus 1.

Incidentally, the basis weight detecting portion 130 or the thickness detecting portion (130) which are described above with reference to FIG. 13 can also be used for detecting the basis weight or the thickness of the original D. Other constitutions are similar to those in the First Embodiment described above, and a similar effect can be obtained.

According to the present invention, it is possible to cool the detecting portion for detecting predetermined information from the recording material without causing upsizing of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-023251 filed on Feb. 13, 2018, which is hereby incorporated by reference herein in its entirety.

What is claimed is:

1. An image forming apparatus comprising:

an image forming portion configured to form a developer image on a recording material;

a fixing portion configured to heat-fix the developer image formed by said image forming portion on the recording material;

a reversing portion configured to reverse a feeding direction of the recording material passed through said fixing portion;

a re-feeding path configured to feed the recording material reversed by said reversing portion to said image forming portion again;

a detecting portion configured to detect predetermined information from the recording material;

a first feeding path along which the recording material passes through a side where a detecting surface of said detecting portion exists;

a second feeding path along which the recording material passes through a side opposite from the detecting surface of said detecting portion and which includes a merging portion where said second feeding path merges with a feeding path configured to feed the recording material passed through said fixing portion;

an air flow generating portion configured to generate air flow; and a flow path forming portion configured to form a flow path along which the air flow is passed between the recording material passing through said second feeding path and a constituent portion constituting said second feeding path on a side toward said detecting portion and configured to guide the recording material passing through said second feeding path, when the recording material passes through said second feeding path.

2. An image forming apparatus according to claim 1, wherein said flow path forming portion includes a guiding rib standing from a surface of said detecting portion on the side opposite from the detecting surface and configured to guide the recording material.

3. An image forming apparatus according to claim 2, wherein said guiding rib is provided so that a longitudinal direction thereof extends in a traveling direction of the recording material passing through said second feeding path.

4. An image forming apparatus according to claim 1, wherein said merging portion is provided upstream of said reversing portion and the detecting surface of said detecting portion provided along said first feeding path.

5. An image forming apparatus according to claim 1, wherein said flow path forming portion includes a plate-like member opposing an opposite surface of said detecting portion on the side opposite from the detecting surface with a gap therebetween through a supporting member standing from the opposite surface and configured to guide the recording material.

6. An image forming apparatus according to claim 1, wherein said detecting portion is at least one of an image reading portion configured to read information on an image formed on the recording material, a basis weight detecting portion configured to detect a basis weight of the recording material, and a thickness detecting portion configured to detect a thickness of the recording material.

7. An image forming apparatus according to claim 1, wherein said detecting portion and said fixing portion are provided at overlapping positions as seen in a vertical direction.

8. An image forming apparatus according to claim 1, further comprising:

a feeding guide configured to form said first feeding path, and an opening provided in said feeding guide, wherein the air flow generated by said air flow generating portion is guided in said first feeding path through said opening, and said opening is provided between said detecting portion and said fixing portion with respect to a vertical direction.

9. An image forming apparatus according to claim 8, wherein said opening is provided at a plurality of positions along a direction perpendicular to a traveling direction of the recording material guided along said feeding guide.

10. An image forming apparatus according to claim 9, wherein said opening is provided so that a longitudinal direction thereof extends along the traveling direction of the recording material.

11. An image forming apparatus according to claim 9, wherein between the positions of said opening, a guiding rib standing from an inner surface of said feeding guide and configured to guide the recording material is provided.

12. An image forming apparatus according to claim 1, wherein said image forming portion includes:

an image bearing member configured to bear the developer image, and a transfer portion configured to transfer the developer image from said image bearing member onto the recording material, wherein with respect to a vertical direction, said transfer portion, said fixing portion and said detecting portion are provided in the listed order from below.

13. An image forming apparatus according to claim 1, wherein said fixing portion and said second feeding path connect said reversing portion and said re-feeding path.

14. An image forming apparatus according to claim 1, wherein said detecting portion is provided at a position opposing said fixing portion through said second feeding path.

15. An image forming apparatus according to claim 1, wherein a part of said first feeding path is provided with an opening through which the air flow generated by said air flow generating portion is guided from said first feeding path toward said second feeding path.

16. An image forming apparatus according to claim 1, wherein said recording material comprises an original, and wherein said image forming apparatus further comprises:

an original feeding portion configured to feed the original toward said detecting portion, an original discharging portion configured to discharge the original passed through said detecting portion, a third feeding path configured to connect said original feeding portion and said detecting portion, and a fourth feeding path configured to connect said detecting portion and said original discharging portion.

17. An image forming apparatus according to claim 16, wherein said original discharging portion also functions as a second reversing portion configured to reverse a feeding direction of the original passed through said detecting portion, wherein said first feeding path connects said original discharging portion and said re-feeding path, and wherein said second feeding path connects said reversing portion and said re-feeding path.

* * * * *